US007942399B2

(12) United States Patent
Hirai et al.

(10) Patent No.: US 7,942,399 B2
(45) Date of Patent: May 17, 2011

(54) SHEET PROCESSING APPARATUS AND IMAGE FORMING APPARATUS HAVING THE SAME

(75) Inventors: Katsuaki Hirai, Moriya (JP); Takeshi Aoyama, Abiko (JP); Shoko Magata, Toride (JP); Yuichi Yamamoto, Toride (JP); Masahiro Funakoshi, Toride (JP); Daijiro Kato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 12/127,426

(22) Filed: May 27, 2008

(65) Prior Publication Data

US 2008/0298929 A1 Dec. 4, 2008

(30) Foreign Application Priority Data

May 30, 2007 (JP) ..... 2007-142899
May 20, 2008 (JP) ..... 2008-131800

(51) Int. Cl.
*B65H 37/04* (2006.01)

(52) U.S. Cl. ..... 270/58.07; 270/58.08; 270/58.12; 270/58.17; 270/58.27; 412/8; 412/33; 412/37

(58) Field of Classification Search ..... 270/58.07, 270/58.08, 58.12, 58.17, 58.27; 412/8, 18, 412/33, 37

See application file for complete search history.

(56) References Cited

U.S. PATENT DOCUMENTS

| | | | | |
|---|---|---|---|---|
| 3,545,741 | A * | 12/1970 | Porth | 270/58.1 |
| 5,013,200 | A * | 5/1991 | Hunder et al. | 412/6 |
| 6,641,345 | B2 * | 11/2003 | Cobene et al. | 412/1 |
| 7,048,269 | B2 * | 5/2006 | Hoarau | 270/52.17 |
| 2002/0067977 | A1 * | 6/2002 | Cobene et al. | 412/1 |
| 2004/0245694 | A1 * | 12/2004 | Hoarau | 270/52.17 |

FOREIGN PATENT DOCUMENTS

| | | |
|---|---|---|
| JP | 64-040564 | 3/1989 |
| JP | 2001-206625 | 7/2001 |
| JP | 2005-138433 | 6/2005 |

* cited by examiner

*Primary Examiner* — Leslie A Nicholson, III
(74) *Attorney, Agent, or Firm* — Fitzpatrick, Cella, Harper & Scinto

(57) ABSTRACT

The invention is to stabilize an amount of application of a glue to sheets, to stabilize adhesive force between the sheets, and to further improve the productivity of a glued sheet bundle. A sheet processing apparatus includes a processing tray 130 that stacks a sheet discharged by a pair of discharge rollers, an attitude changing unit 150 that displaces the aligned sheet bundle on the processing tray 130 to partially expose sheet surfaces, an adhesive agent delivery device 160 that applies a glue to the exposed parts of the sheet surfaces of the displaced sheet bundle on the processing tray 130, and a sheet bundle aligning portion such as aligning plates 140 and 141 that aligns the glued sheet bundle.

25 Claims, 30 Drawing Sheets

SHEET PROCESSING APPARATUS AND IMAGE FORMING APPARATUS HAVING THE SAME

BACKGROUND OF THE INVENTION

1. Field of the Invention

The present invention relates to a sheet processing apparatus that partially applies a glue on each of sheets to form a glued sheet bundle and an image forming apparatus comprising the sheet processing apparatus.

2. Description of the Related Art

In recent years, a sheet processing apparatus in that causes a pasting process apparatus to apply a glue at predetermined positions on sheets on which an image is recorded by an image forming apparatus and bundle the glued sheets to form a sheet bundle (to bind a book) is proposed.

For example, in a technique disclosed in Japanese Patent Application laid-Open (JP-A) No. 2001-206625, a glue is applied to sheets discharged from an image forming apparatus successively during conveyance, and these sheets are superposed on each other to form (bind up) a glued sheet bundle.

However, in the technique as described in JP-A No. 2001-206625, since a glue is applied to sheets in conveyance successively, a long period of time is required to form a glued sheet bundle. In order to improve the productivity of glued sheets, a conveyance speed of the sheets may be increased to increase an applying speed of the glue accordingly. However, in this case, an application amount of the glue to be applied to the sheets is not stable, and adhesive force between the sheets becomes sparse, so that the quality of the glued sheet bundle may be deteriorated. Since the glue-applied sheets are conveyed, the glue applied to the sheets is dried in the conveyance, and adhesive force between the sheets may be deteriorated. Furthermore, a sheet conveyance portion must be provided to prevent the glue applied to the sheets from adhering to the sheet conveyance portion which conveys the sheets.

SUMMARY OF THE INVENTION

The present invention is to stabilize an application amount of a glue to sheets, to stabilize adhesive force between sheets, and to improve the productivity of a glued sheet bundle.

As a typical configuration of the present invention for achieving the above object, the present invention provides a sheet processing apparatus including: a sheet stacking portion that stacks a sheet discharged by a sheet discharge portion; a sheet bundle displacing unit that displaces a sheet bundle stacked on the sheet stacking portion to partially expose sheet surfaces; and a glue applying unit that applies the glue to the exposed parts of the sheet surfaces of the displaced sheet bundle on the sheet stacking portion.

According to the present invention, the glue is applied to the exposed sheet surfaces of the sheet bundle on the sheet stacking portion collectively. With this process, an application amount of the glue to the sheets can be stabilized. Adhesive force between the sheets can also be stabilized. Furthermore, the productivity of the glued sheet bundle can be improved.

Further features of the present invention will become apparent from the following description of exemplary embodiments with reference to the attached drawings.

DESCRIPTION OF THE EMBODIMENTS

Preferable embodiments of the present invention will be illustratively described below with reference to the accompanying drawings. Wherein, sizes, materials, shapes, and a relative arrangement of constituent elements described in the following embodiments should be appropriately changed depending on the configuration and various conditions of apparatuses to which the present invention is applied. Therefore, unless otherwise noted, the spirit and scope of the invention are not limited only to the embodiments.

First Embodiment

Figure 1:
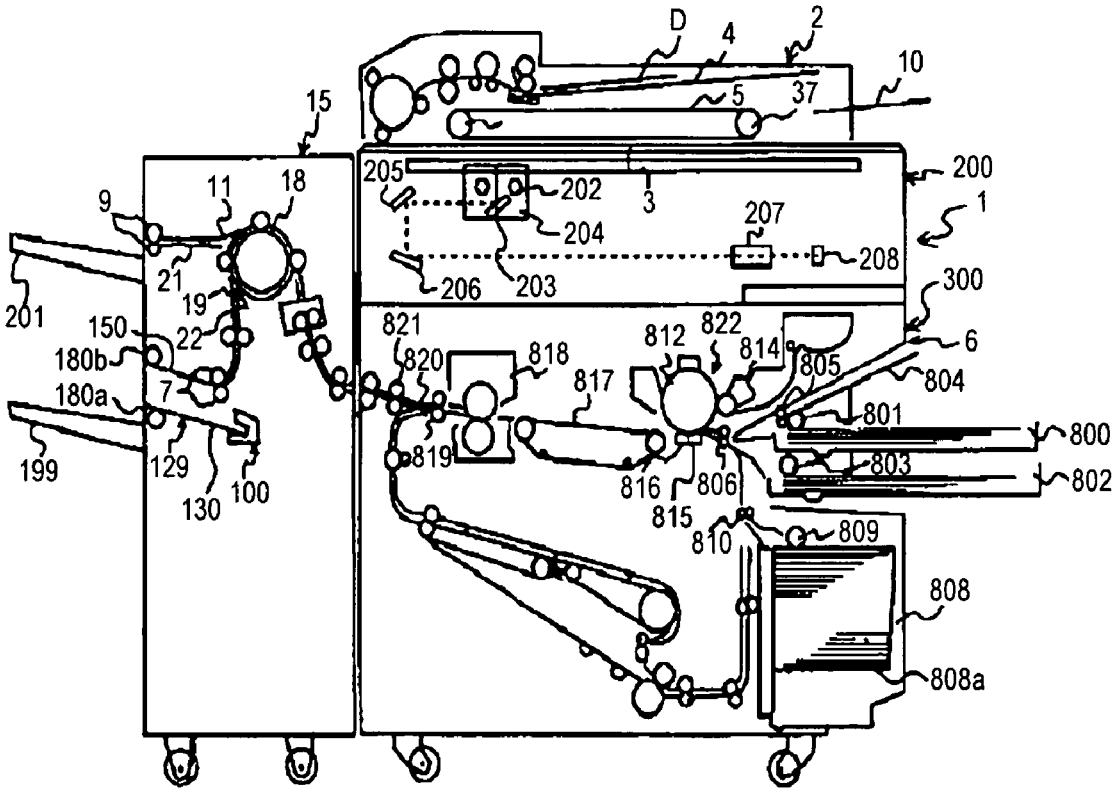
FIG. 1 is a sectional view illustrating a schematic configuration of an image forming apparatus comprising a sheet processing apparatus.
Figure 2:
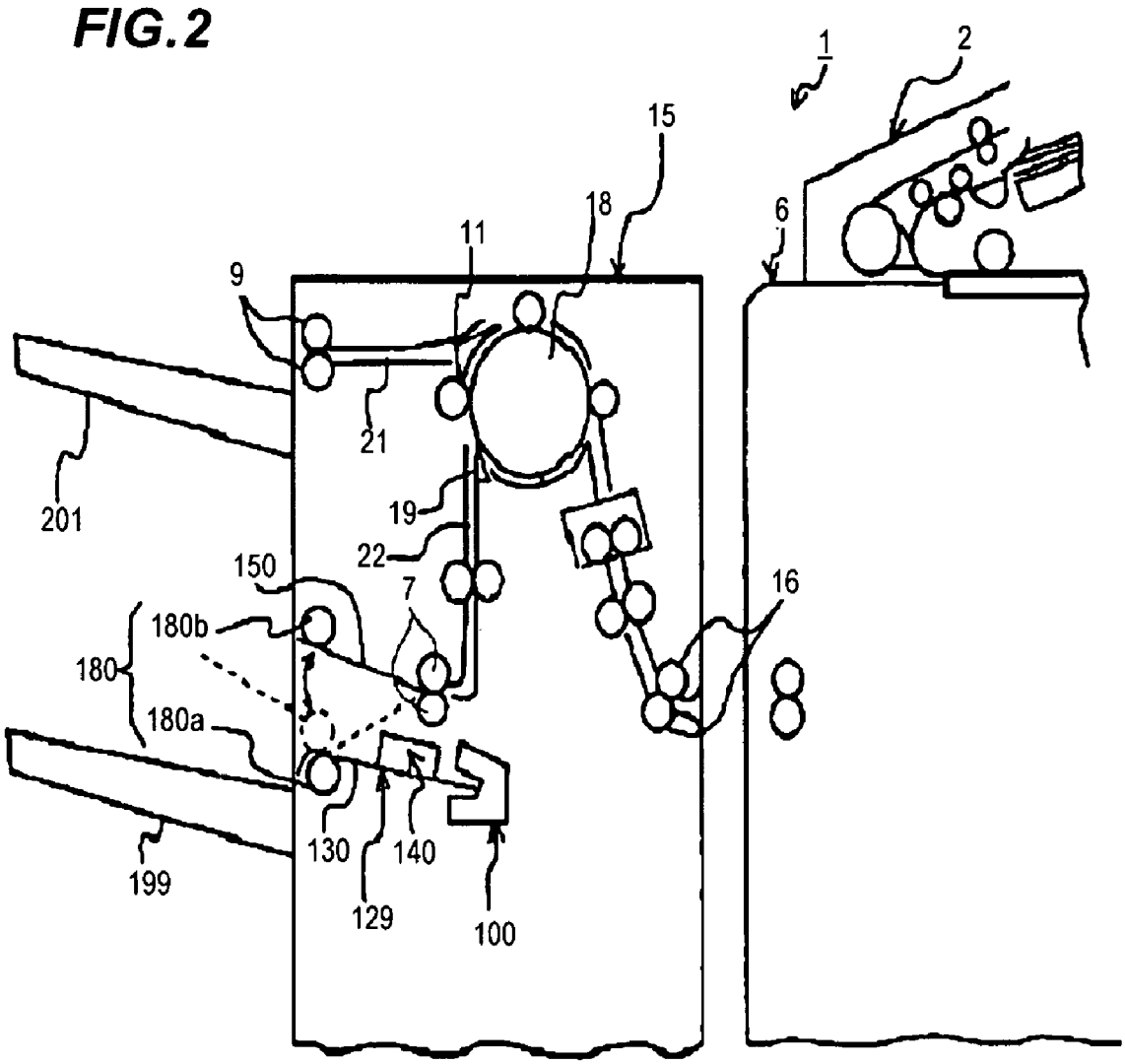
FIG. 2 is a sectional view illustrating a schematic configuration of the sheet processing apparatus.

An image forming apparatus comprising a sheet processing apparatus will be described below with reference to FIGS. 1 and 2. FIG. 1 is a typical sectional view illustrating a schematic configuration of an image forming apparatus comprising a sheet processing apparatus. In this case, a copying machine is illustrated as the image forming apparatus. FIG. 2 is a typical sectional view illustrating a schematic configuration of the sheet processing apparatus.

In FIGS. 1 and 2, an image forming apparatus 1 includes an original conveying apparatus (ADF) 2, a reader portion 200, a printer portion 300, a sheet processing apparatus 15 having a sheet aligning device 129, and the like.

The original conveying apparatus 2 has an original tray 4 provided thereabove, and a broad belt 5 winded around a drive roller 36 and a turn roller 37. An original D on the original tray 4 is sequentially separated and fed from the uppermost sheet by a separation unit and then conveyed onto a platen glass 3 at a read position of a main body 6 of the image forming apparatus 1.

The broad belt 5 abuts against an upper surface of the platen glass 3 such that the broad belt 5 can be freely rotated forward or backward. The broad belt 5 conveys the original D conveyed from the original tray 4 to a predetermined position of the platen glass 3, and conveyed out on an original discharge tray 10. The original D is stacked on the original tray 4 from above in the order named: page 1 (page 2), page 3 (page 4), . . . .

The main body 6 of the image forming apparatus 1 includes the reader portion 200 and the printer portion 300. The reader portion 200 has the platen glass 3, a scanner unit 204, mirrors 205 and 206, a lens 207, and an image sensor 208. An image recorded on the original D is optically read and photoelectrically converted into image data, and the image data is input to the printer portion 300. The scanner unit 204 has a lamp 202 and a mirror 203.

The printer portion 300 will be described below. The printer portion 300 is designed to copy an original image on a sheet by an electrostatic latent image scheme. The printer portion 300 is also designed to form an image on a sheet by an external information signal.

An upper cassette 800 stores sheets. The sheets in the upper cassette 800 are separately fed one by one to a pair of registration rollers 806 by a separation claw (not shown) and a conveying roller 801. The sheets in the lower cassette 802 are also separately fed one by one to a pair of registration rollers 806 by a separation claw (not shown) and a conveying roller 803. The manual feed guide 804 is designed to supply a sheet by a manual feed operation by a user. The sheet supplied to the manual feed guide 804 is fed to the pair of registration rollers 806 by a roller 805. A deck-type sheet stacking device 808 comprises an intermediate plate 808*a* vertically moved by a motor or the like. Sheets on the intermediate plate 808*a* are separately fed one by one to the pair of registration rollers 806 through a conveying roller 810 by a conveying roller 809 and a separation claw (not shown).

One original stacked on the platen glass 3 is read by the reader portion 200. On the basis of the read original information, an electrostatic latent image is formed on a photosensitive drum 812 by a write optical system (not shown). Each time a toner image is formed on the photosensitive drum 812 by a development device 814, a predetermined number of sheets the number of which is set by a user are fed from any one of the cassettes 800 and 802, the sheet stacking device 808, and the manual feed guide 804 to the photosensitive drum 812. Alignment between the image on the photosensitive drum 812 and the sheet is performed by the pair of registration rollers 806.

When images are formed on a required number of sheets, the originals are discharged from the platen glass 3, and the next original is positioned on the platen glass 3. The image forming apparatus 1 will be copies the image of the original on sheets by the same manner as described above.

When a sheet is supplied from any one of the cassettes 800 and 802, the sheet stacking device 808, and the manual feed guide 804 to the photosensitive drum 812, a toner image on the photosensitive drum 812 is transferred to the sheet by a transfer charger 815. The toner image is formed on the photosensitive drum 812 by the development device 814 in advance. The sheet is separated from the photosensitive drum 812 by a separating charger 816. The photosensitive drum 812, the development device 814, the transfer charger 815, the separating charger 816, and the like constitute an image forming portion 822.

The sheet on which the toner image is formed is conveyed to a fixing device 818 by convey belt 817. The fixing device 818 heats and pressures the sheet to fix the toner image on the sheet. Thereafter, a conveying roller 819 feeds the sheet on which the toner image is fixed to a switching member 820. The switching member 820 leads the sheet on which the toner image is fixed to a main-body discharge roller 821 and guides the sheet to the sheet processing apparatus 15.

In FIG. 2, a flow of a sheet in a non-sort mode will be described below. The sheet conveyed from the main body 6 of the image forming apparatus 1 into the sheet processing apparatus 15 is discharged to a sample tray 201 by a second pair of discharge rollers 9 through a pair of inlet rollers 16, a buffer roller 18, a first switching member 11, and a non-sort-mode path 21. In the sort mode, the sheets are sequentially temporarily stacked on a processing tray 130 serving as an intermediate tray by a first pair of discharge rollers 7 serving as a sheet discharge portion through the pair of inlet rollers 16, the buffer roller 18, a second switching member 19, and a sort-mode path 22.

The processing tray 130 is a sheet stacking portion that stacks a sheet discharged by the first pair of discharge rollers 7. The sheet on the processing tray 130 is aligned at an end portion in a sheet width direction by aligning plates 140 and 141 and aligned at an end portion in a conveying direction by a rear end regulating plate 120 or the like. Furthermore, sheets on the processing tray 130 are partially glued collectively by an adhesion processing portion 101 (will be described later) to form a sheet bundle. The sheet bundle formed as described above is discharged onto a stack tray 199 by a pair of bundle discharge rollers 180 which can abut against each other and can be separated from each other.

Figure 3:
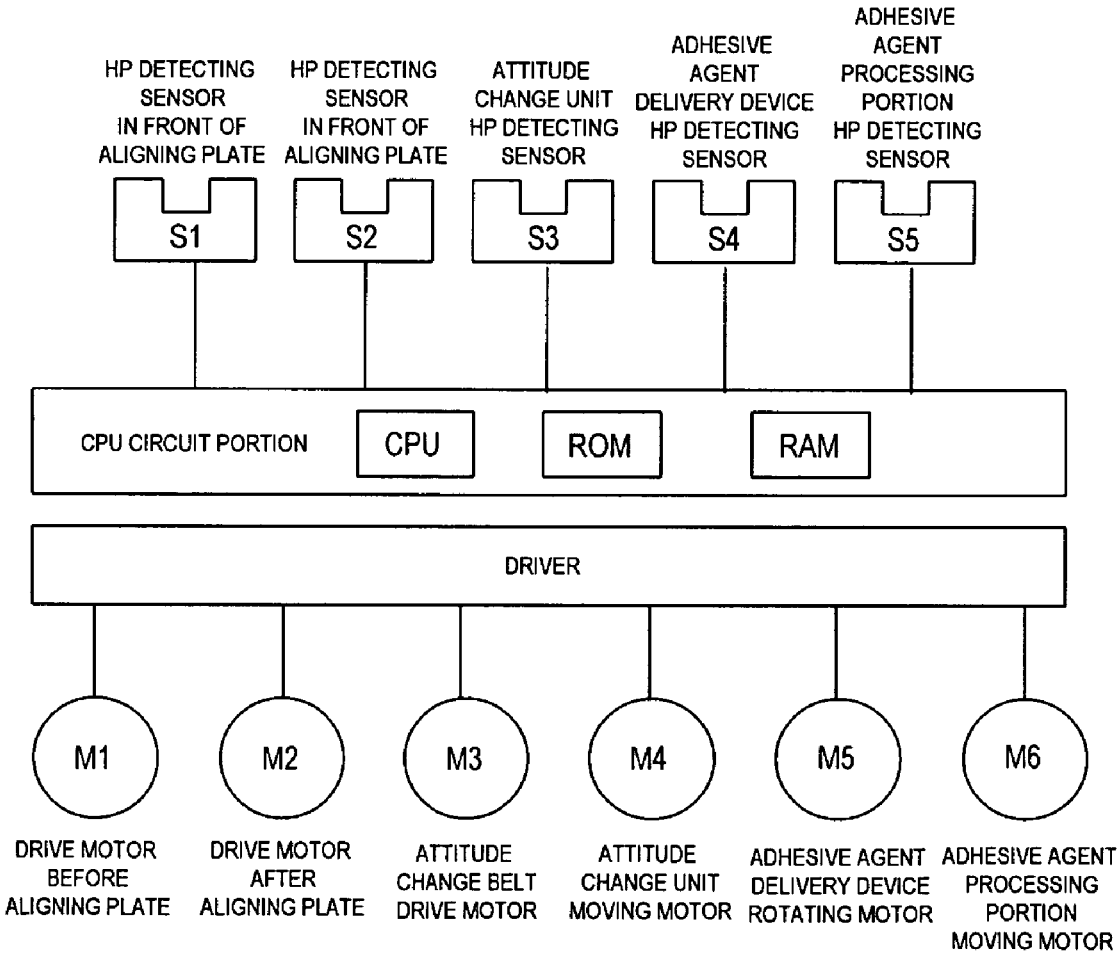
FIG. 3 is a block diagram illustrating a configuration of a control system of the sheet processing apparatus.
Figure 4:
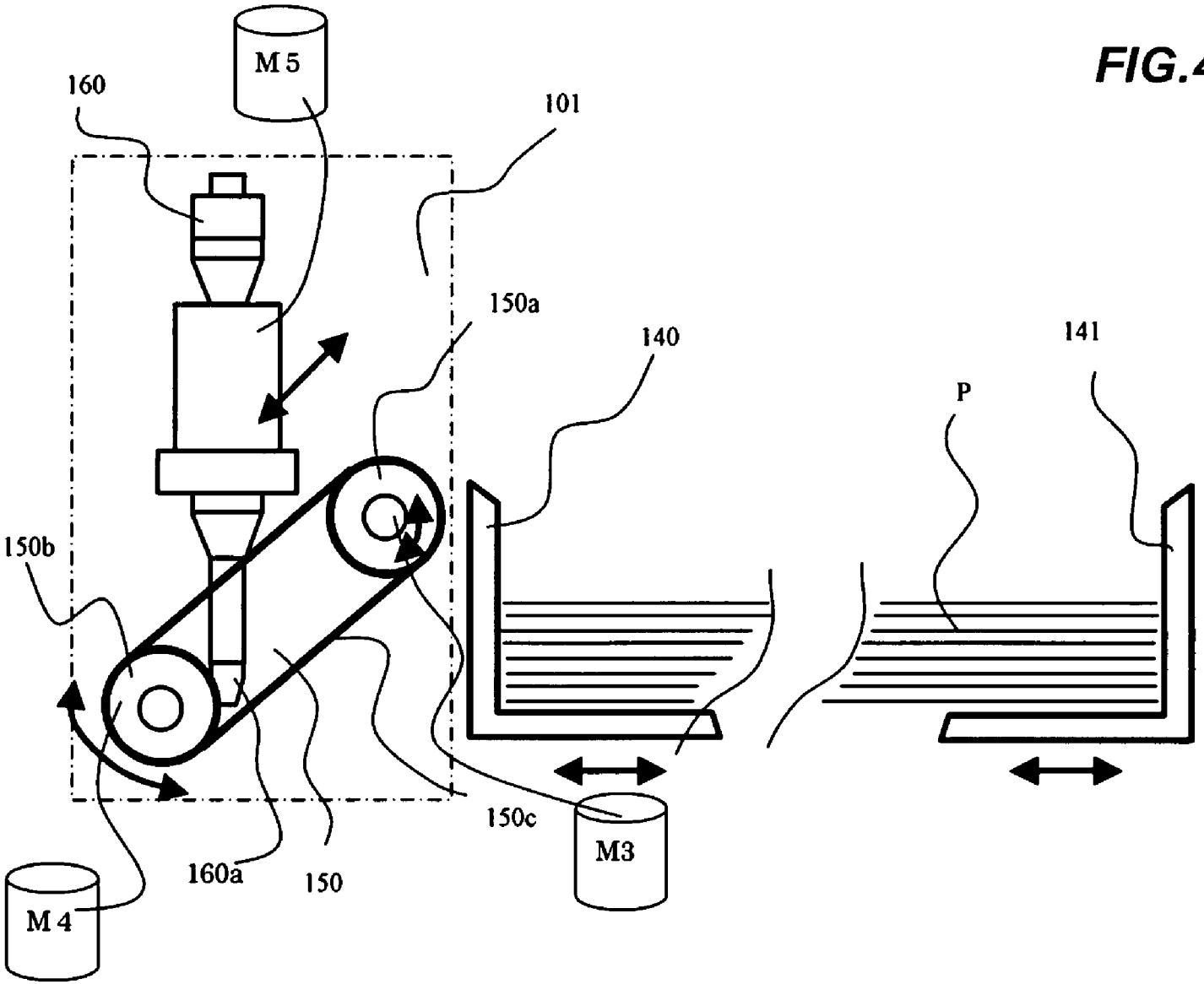
FIG. 4 is a sectional view illustrating a configuration of a main part of a sheet processing apparatus according to a first embodiment.
Figure 5:
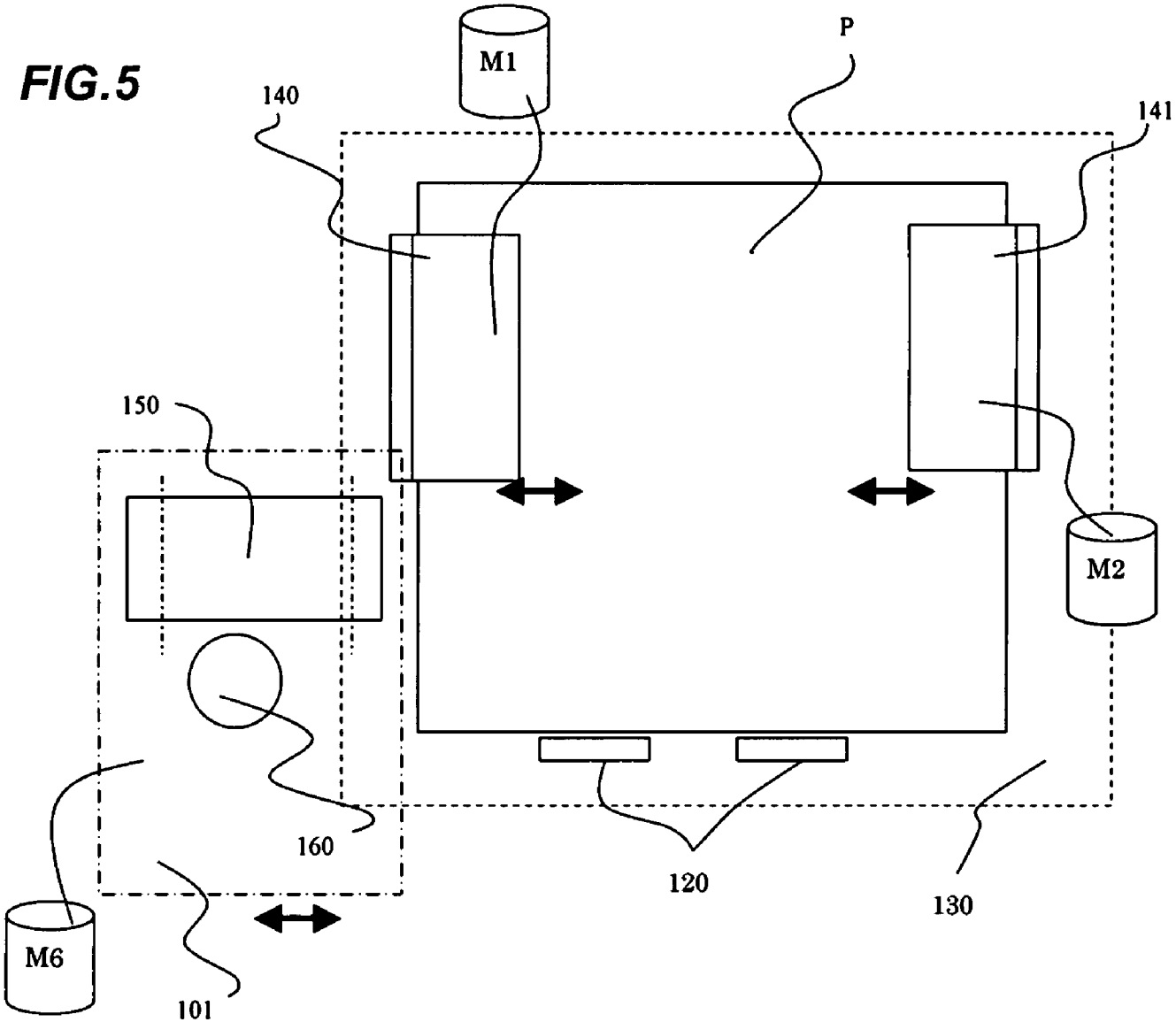
FIG. 5 is a plan view illustrating the configuration of the main part of the sheet processing apparatus according to the first embodiment.

The sheet aligning device 129 serving as a sheet aligning portion will be described below. In FIGS. 3, 4, and 5, on the processing tray 130, the rear end regulating plate 120 that regulates a convey-direction end portion of a sheet P and the aligning plates 140 and 141 that regulate the width-direction end portions of the sheet P are provided. The rear end regulating plate 120 is fixed to the processing tray 130. However, the aligning plates 140 and 141 are held by the processing tray 130 such that the aligning plates 140 and 141 can be moved in directions of arrows, respectively, and the aligning plates 140 and 141 are driven by drive motors M1 and M2 through drive transmitting portions (not shown), respectively. The rear end regulating plate 120, the aligning plate 140, and the aligning plate 141 constitute the sheet aligning device 129 that aligns two orthogonal sides of each sheet discharged onto the processing tray 130.

The adhesion processing portion 101 will be described below. In FIGS. 3, 4, and 5, the adhesion processing portion 101 has an attitude changing unit 150 including an attitude changing pulleys 150*a* and 150*b* and an attitude changing belt 150*c*. The attitude changing unit 150 is a sheet bundle displacing unit that displaces an aligned sheet bundle on the processing tray 130 such that a part of each sheet surface is exposed. The attitude changing belt 150*c* is rotationally driven by a drive motor M3 through a drive transmitting portion (not shown). The attitude changing unit 150 is oscillated by a drive motor M4 through a drive transmitting portion (not shown) in an arrow direction (direction in which the sheet bundle is displaced such that sheet surfaces are partially exposed). The adhesion processing portion 101 has an adhesive agent delivery device 160 that delivers a predetermined amount of adhesive agent from a delivery portion 160*a*. The adhesive agent delivery device 160 is a glue applying unit that applies a glue to the exposed parts of the sheet surfaces of the displaced sheet bundle on the processing tray 130. The adhesive agent delivery device 160 is moved by a drive motor M5 through a drive transmitting portion (not shown) in an arrow direction (direction along the exposed sheet surfaces of the displaced sheet bundle). The adhesion processing portion 101 is moved by a drive motor M6 through a drive transmitting portion (not shown) in an arrow direction.

As shown in FIG. 3, the motors M1 to M6 are driven under the control of a CPU circuit portion serving as a controller on the basis of pieces of information of detection sensors S1 to S5. The CPU circuit portion has a CPU, a ROM, and a RAM built therein and integrally controls drivers of the motors M1 to M3 by a control program stored in the ROM. The RAM temporarily holds control data and is used as a work area of an arithmetic process based on the control.

In this case, a sheet adhering process (hereinafter, referred to as an adhesive sort mode hereinafter) performed in a sort mode will be described below with reference to FIG. 6.

As an entire process flow in the adhesive sort mode, a processing tray stacking step, an adhesion process step, and a bundle discharge step are sequentially performed. The steps will be described below.

In the processing tray stacking step, as described above, sheets P are sequentially discharged onto the processing tray 130 by the first pair of discharge rollers 7 through the pair of inlet rollers 16, the buffer roller 18, the second switching member 19, and the sort-mode path 22. The sheet P discharged onto the processing tray 130 begins to move to the rear end regulating plate 120 by the weight of the sheet P. In addition, a paddle (not shown) stopped at a home position is rotated to promote movement of the sheet P toward the rear end regulating plate 120. When the rear end of the sheet P reliably abuts against the rear end regulating plate 120 and stops, the rotation of the paddle also stops. Furthermore, the sheet P is aligned by the aligning plate 140 and the aligning plate 141. Each time the sheet is discharged onto the processing tray 130, the aligning operation is repeated. In this manner, two orthogonal sides of each sheet on the processing tray 130 are aligned. The processing tray stacking step preferably takes in an aligning operation such that adhesive agent applying positions of the sheets are constant in an adhesion process step (will be described later) to enable a favorable adhesion process. However, the adhesive agent applied positions may fall within some area. The aligning operation may be omitted.

The adhesion process step will be described below with reference to the operation flows in FIGS. 6A to 6F and FIG. 7.

Figure 6A:
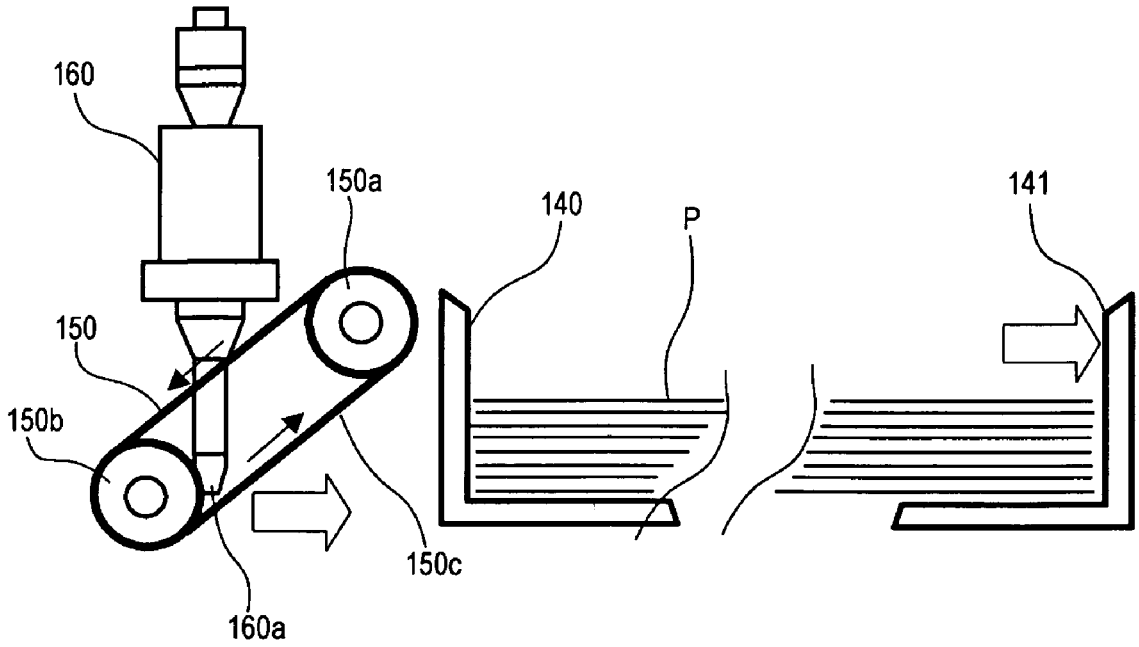
FIG. 6A is a sectional view illustrating an operating state of an adhesion process step of the sheet processing apparatus according to the first embodiment.

When the sheets P are completely stacked on the processing tray 130 as described above (step S1), the drive motor M2 is driven to retreat the aligning plate 141 from an end surface of the sheet bundle P (arrow direction in FIG. 6A) (steps S2 to S4). Accordingly, the attitude changing belt 150*c* is rotated in an arrow direction (step S5) to cause the adhesion processing portion 101 to abut against the end surface of the sheet bundle P (move in the arrow direction in 6*a*). At this time, an attitude of the attitude changing belt 150*c* is such an attitude that the aligned sheet bundle P on the processing tray 130 is displaced to partially expose the sheet surfaces as shown in FIG. 6A.

Figure 6B:
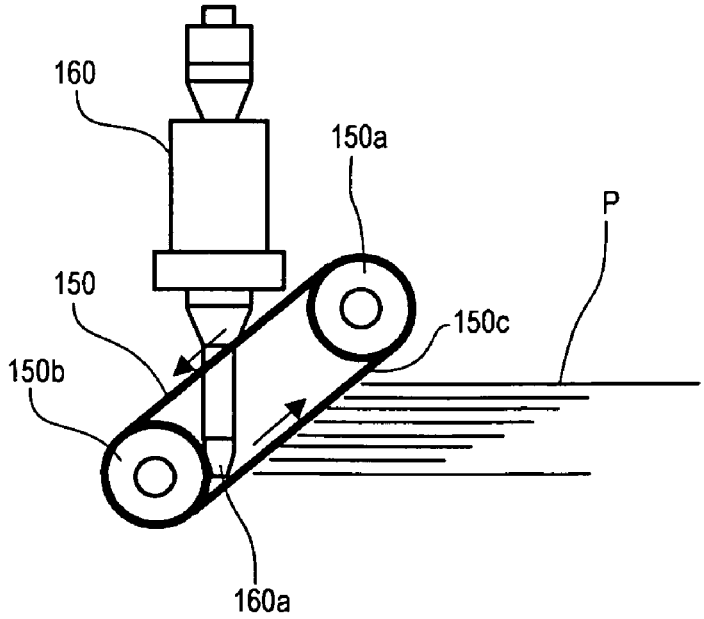
FIG. 6B is a sectional view illustrating an operating state of the adhesion process step of the sheet processing apparatus according to the first embodiment.

By the operation, the ends of the sheets of the aligned sheet bundle P on the processing tray 130, as shown in FIG. 6B, spread such that parts of the sheet surfaces are uniformly exposed by the rotating attitude changing belt 150*c*, and the attitude of the sheet bundle P is obliquely changed. At this time, in the aligned sheet bundle P, one of two orthogonal sides of each sheet is regulated by the rear end regulating plate 120 to maintain an alignment state. More specifically, the other sides orthogonal to the sheet conveying direction in the sheets are shifted by a predetermined amount while maintaining an alignment state at a rear end in the sheet conveying direction, and the attitude is changed such that the end of the sheet P obloquies as shown in FIG. 6B.

Figure 6C:
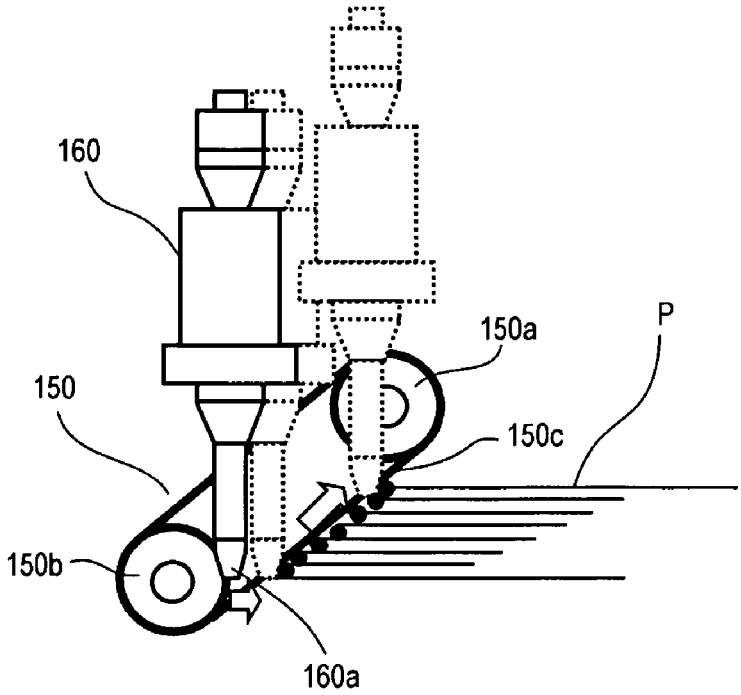
FIG. 6C is a sectional view illustrating an operating state of the adhesion process step of the sheet processing apparatus according to the first embodiment.

The adhesive agent delivery device 160, as shown in FIG. 6C, sequentially delivers a predetermined amount of adhesive agent to the exposed parts of the sheet surfaces of a predetermined number of uniformly spread sheets, while moving along the end face of the sheet bundle P the attitude of which is obliquely changed (steps S6 to S9). In movement of the adhesive agent delivery device 160, when the uppermost sheet P is detected by a detecting portion (not shown), the adhesive agent delivery device 160 stops such that an adhesive agent is not delivered onto the uppermost sheet, and the adhesive agent delivery process which is a glue applying process is completed (step S10). In this case, the adhesive agent delivery device 160 delivers an adhesive agent to one corner (see FIG. 8) of each of the exposed sheet surfaces, while moving along the end surface of the sheet bundle which is obliquely shifted as described above.

Figure 6D:
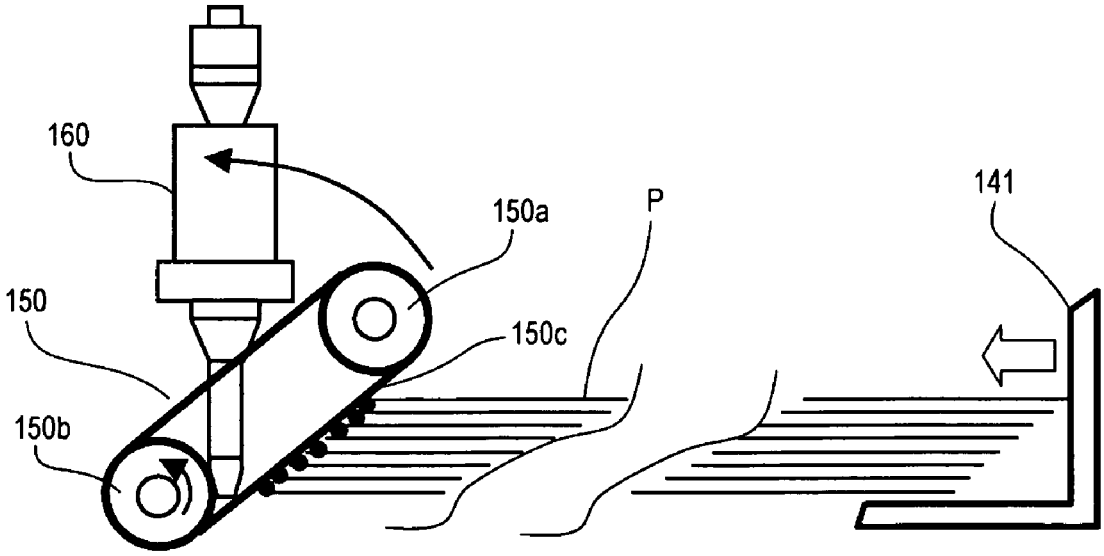
FIG. 6D is a sectional view illustrating an operating state of the adhesion process step of the sheet processing apparatus according to the first embodiment.
Figure 6E:
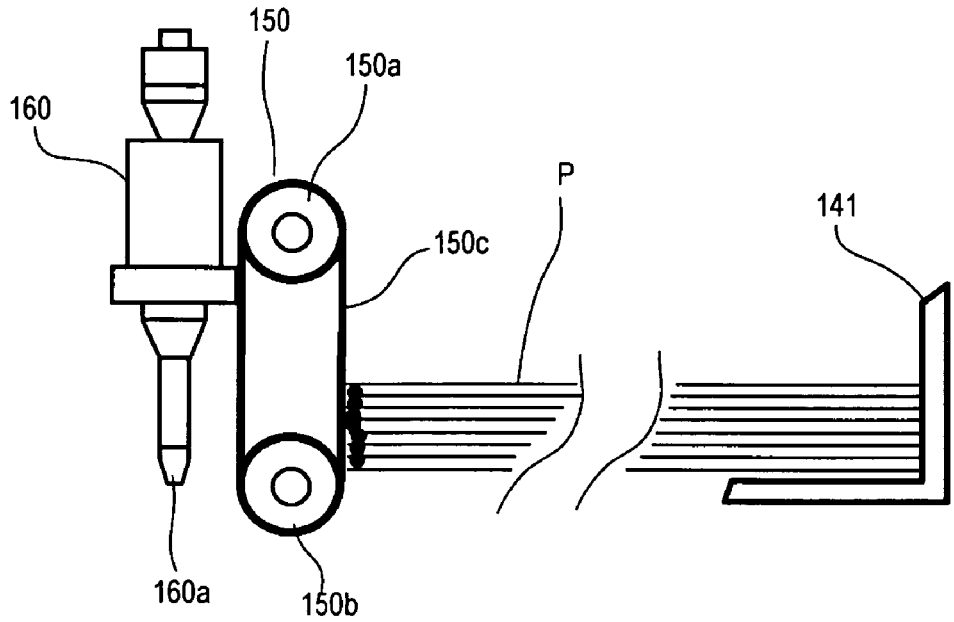
FIG. 6E is a sectional view illustrating an operating state of the adhesion process step of the sheet processing apparatus according to the first embodiment.
Figure 6F:
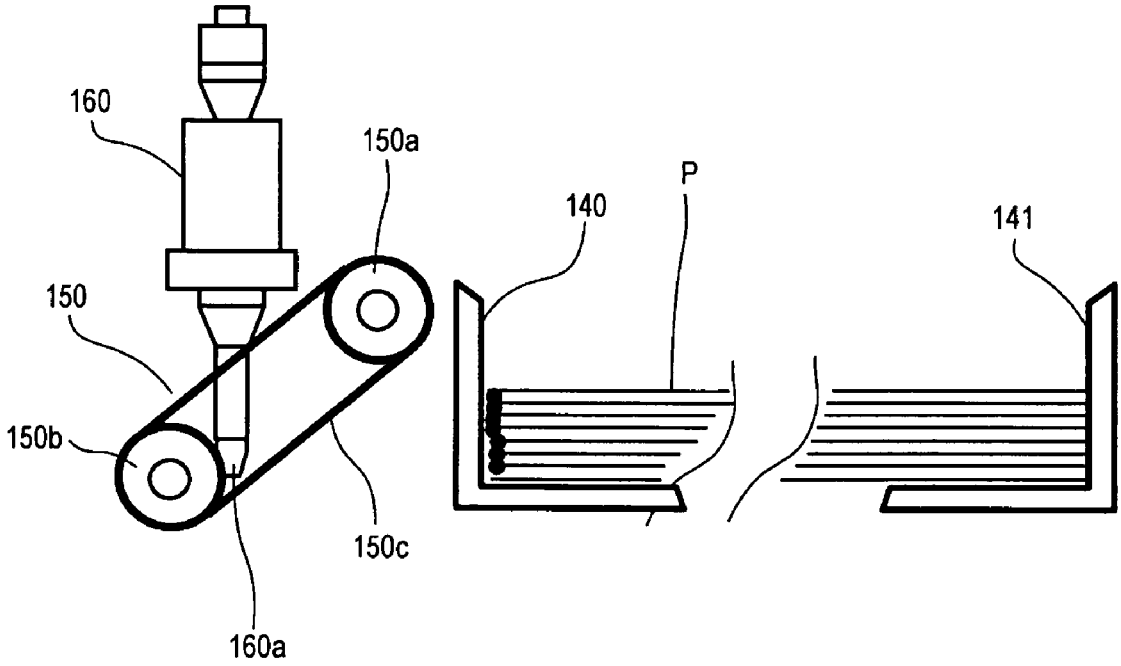
FIG. 6F is a sectional view illustrating an operating state of the adhesion process step of the sheet processing apparatus according to the first embodiment.
Figure 7:
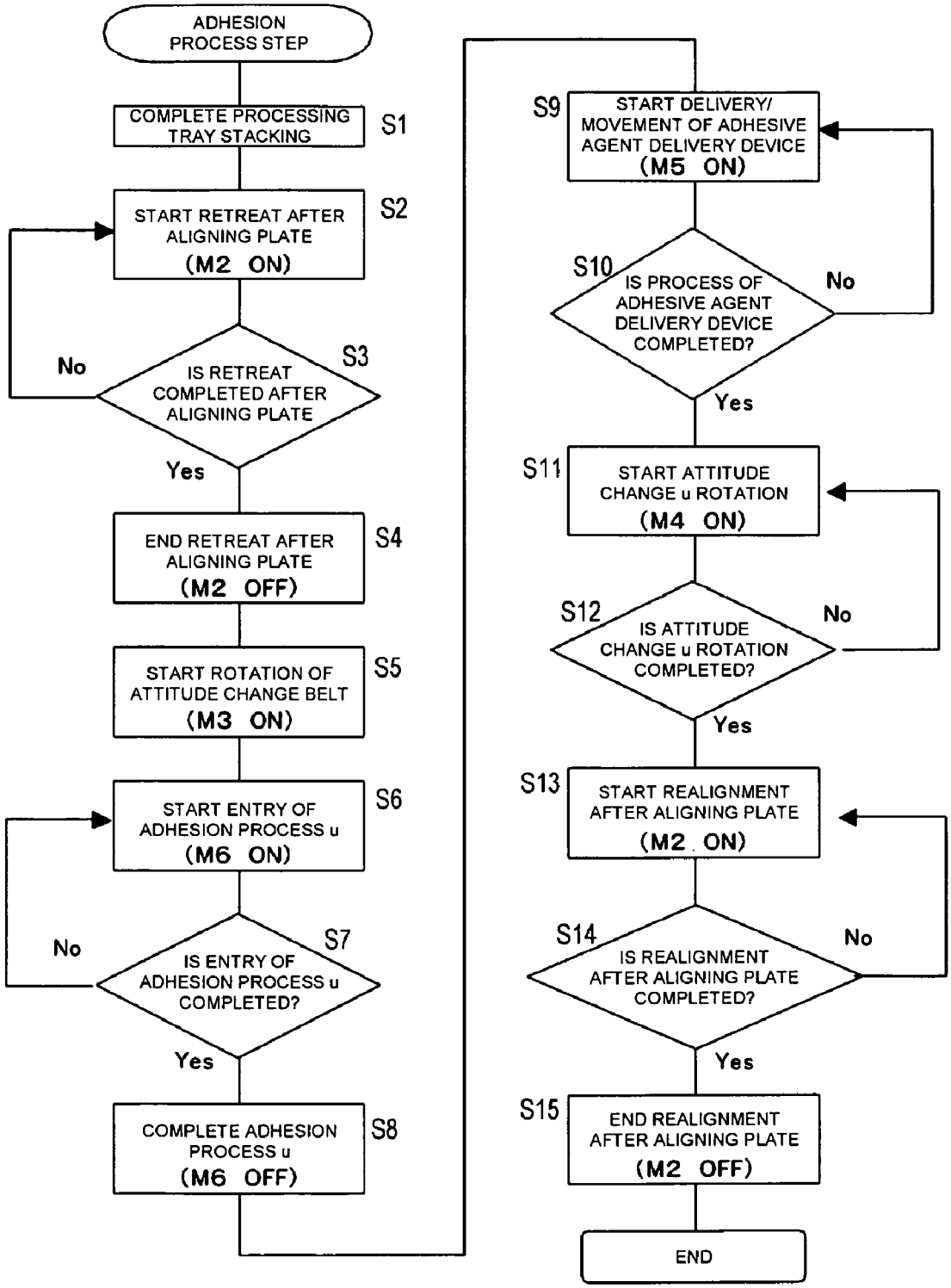
FIG. 7 is a flowchart illustrating an operation flow of the adhesion process step of the sheet processing apparatus according to the first embodiment.

Upon completion of the adhesive agent delivery process, as shown in FIG. 6D, the attitude changing unit 150 is rotationally driven about the an attitude changing pulley 150*b* such that a sheet abutting surface of the attitude changing belt 150*c* is substantially vertical. Accordingly, the aligning plate 141 is moved in an arrow direction in FIG. 6D. At this time, a sheet contact surface of the attitude changing belt 150*c* the attitude of which is nearly changed to the vertical state serves as an alignment reference for a sheet bundle together with the aligning plate 140 to realign the sheet bundle the attitude of which is changed to obtain an oblique end surface and on which the adhesive agent is applied. The sheet bundle is aligned by the operation as shown in FIG. 6E while maintaining the alignment state of one of the two orthogonal sides of each of the sheets, so that the sheet bundle is set in the original state in which the two orthogonal sides of each of the sheets are aligned. More specifically, the attitude changing unit 150, the aligning plate 140, and the aligning plate 141 function as a sheet bundle aligning portion that align the glued sheet bundle on the processing tray 130.

When the adhesion process to the sheet bundle is completed as described above, as shown in FIG. 6F, the adhesion processing portion 101 returns to a predetermined position and is standby in an initial state.

In the bundle discharge step, upon completion of the adhesion process to the first sheet bundle as described above, as indicated by a broken line in FIG. 2, an upper bundle discharge roller 180*b* serving as one of the pair of bundle discharge rollers 180 moves downward to be put on the sheet bundle. The upper bundle discharge roller 180*b* discharges the sheet bundle on the processing tray 130 onto the stack tray 199 together with a lower bundle discharge roller 180*a* which is the other of the pair of bundle discharge rollers 180. The pair of bundle discharge rollers 180 function as a pressing portion which presses a sheet bundle aligned by the attitude changing unit 150, the aligning plate 140, and the aligning plate 141, the sheets of the bundle are brought into press contact with each other to increase adhesive force.

As described above, according to the embodiment, the attitude of the sheet bundle stacked and aligned on the processing tray 130 is changed, and an adhesive agent is applied to the sheet surfaces exposed by the change in attitude collectively. With this process, an amount of application of the adhesive agent to the sheets can be stabilized. Furthermore, the productivity of the glued sheet bundle can be improved.

Second Embodiment

Figure 8:
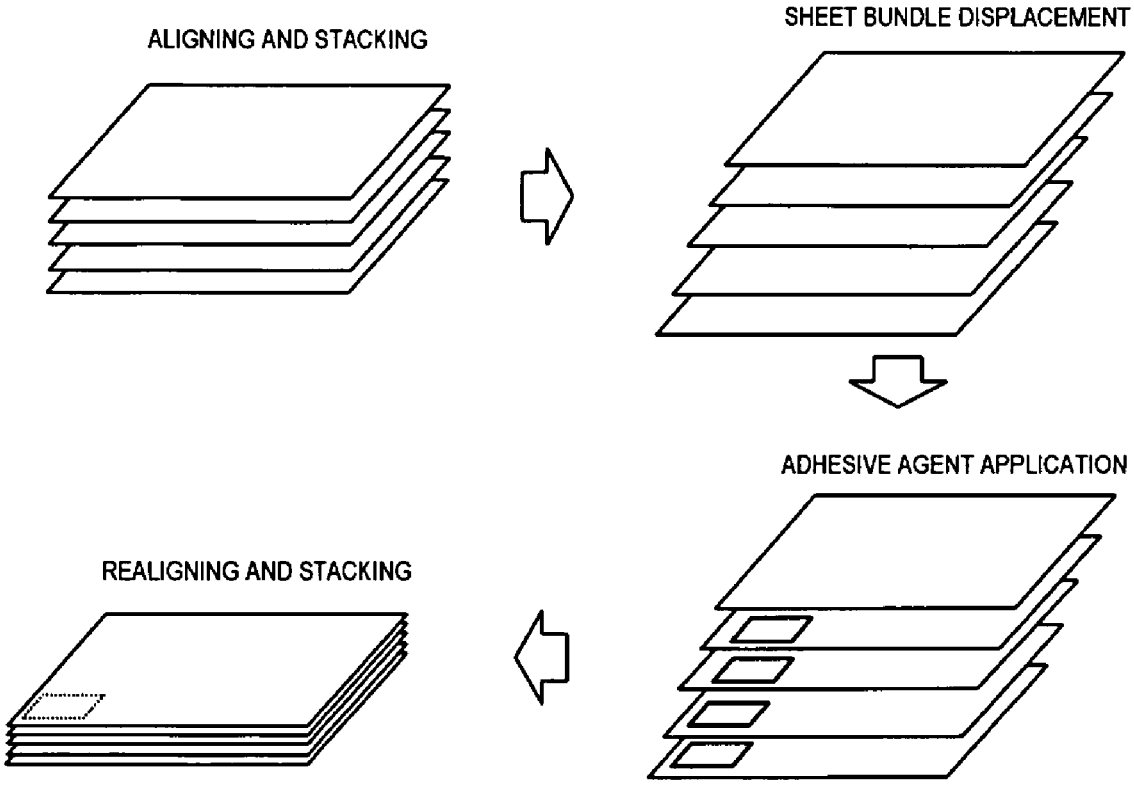
FIG. 8 is an explanatory view illustrating a flow of an operation of the sheet processing apparatus according to the first embodiment by a sheet stacking state.
Figure 9:
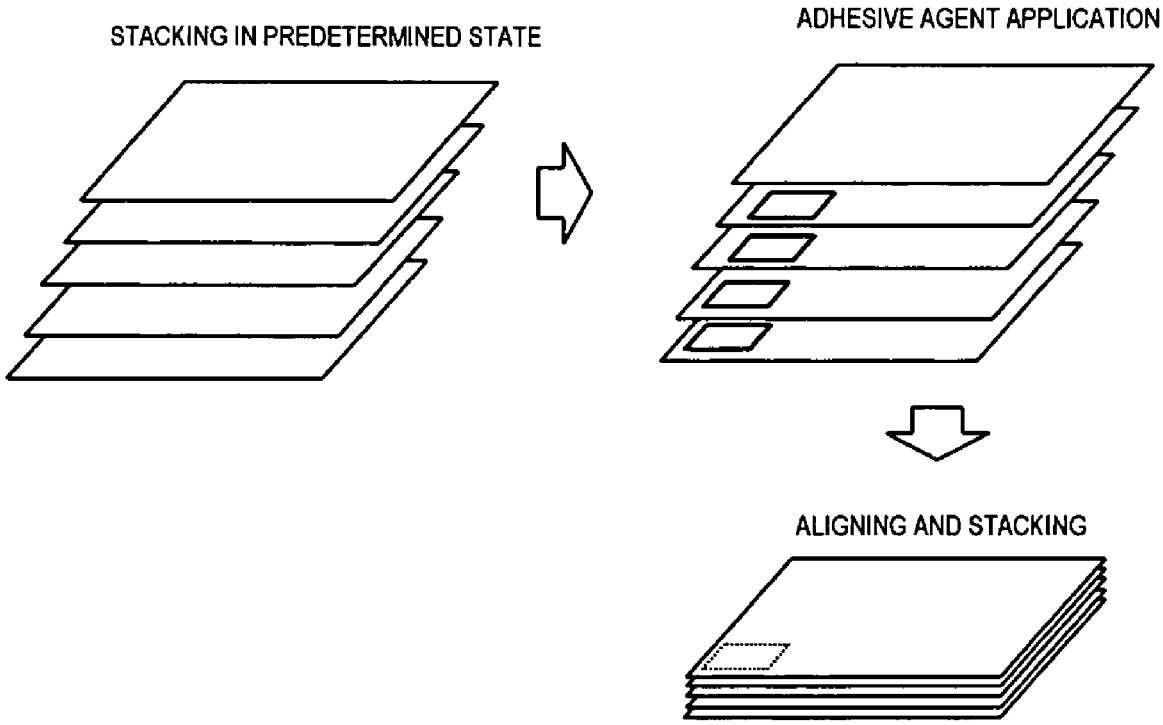
FIG. 9 is an explanatory view illustrating a flow of an operation of a sheet processing apparatus according to a second embodiment.

In the first embodiment, as shown in FIG. 8, (1) after sheets are stacked and aligned, (2) a sheet bundle is displaced, (3) thereafter, an adhesive agent is applied to the displaced sheets, and (4) finally, the sheet bundle is realigned. In contrast to this, in this embodiment, as shown in FIG. 9, (1) a sheet bundle is stacked such that an adhesive agent can be applied to sheet surfaces, (2) an adhesive agent is applied to the sheet bundle in the above mentioned state, and (3) finally, the sheet bundle is aligned. A sheet processing apparatus according to the second embodiment will be described below with reference to FIGS. 10, 11, and 12.

Figure 10:
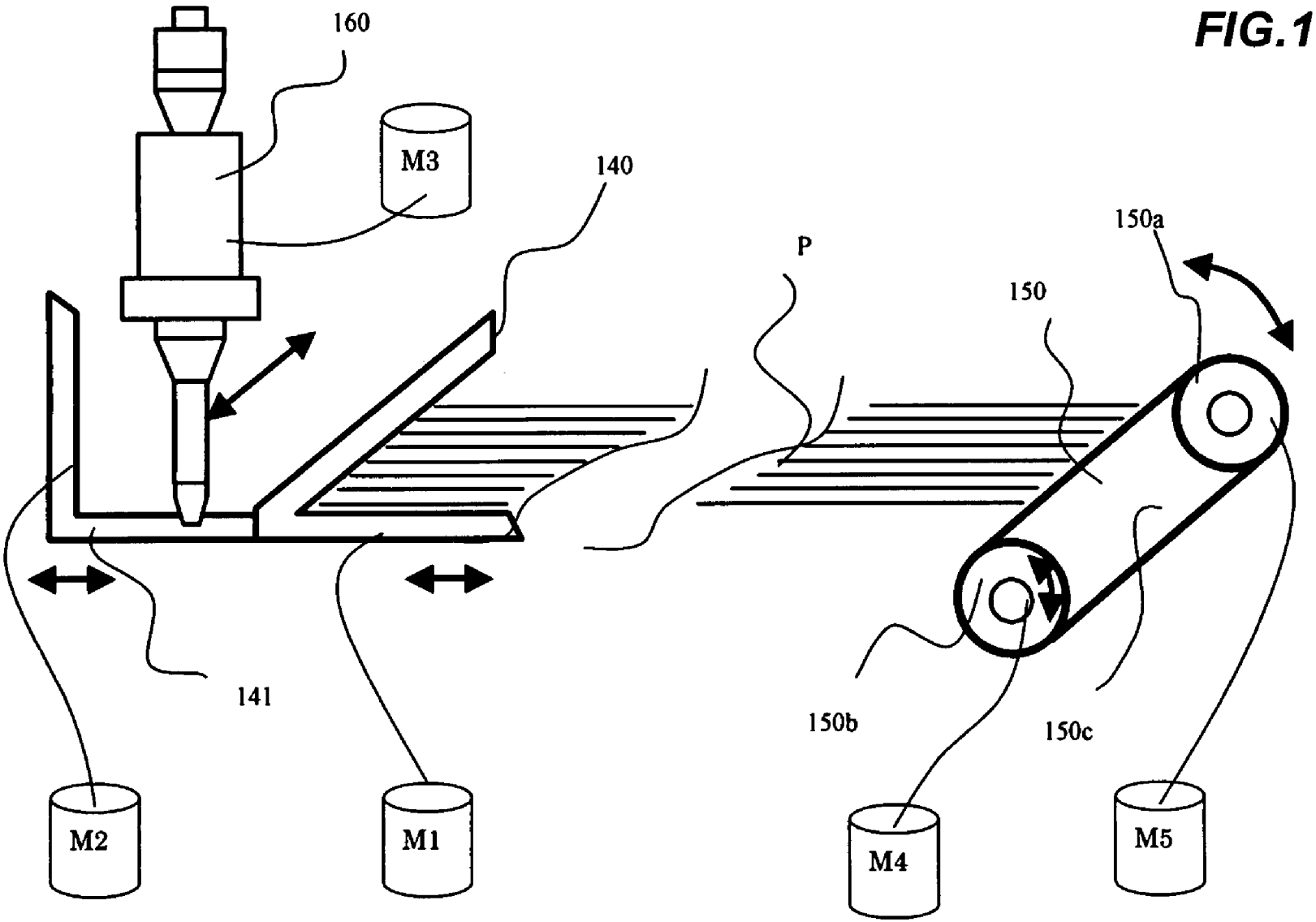
FIG. 10 is a sectional view illustrating a configuration of a main part of the sheet processing apparatus according to the second embodiment.
Figure 11:
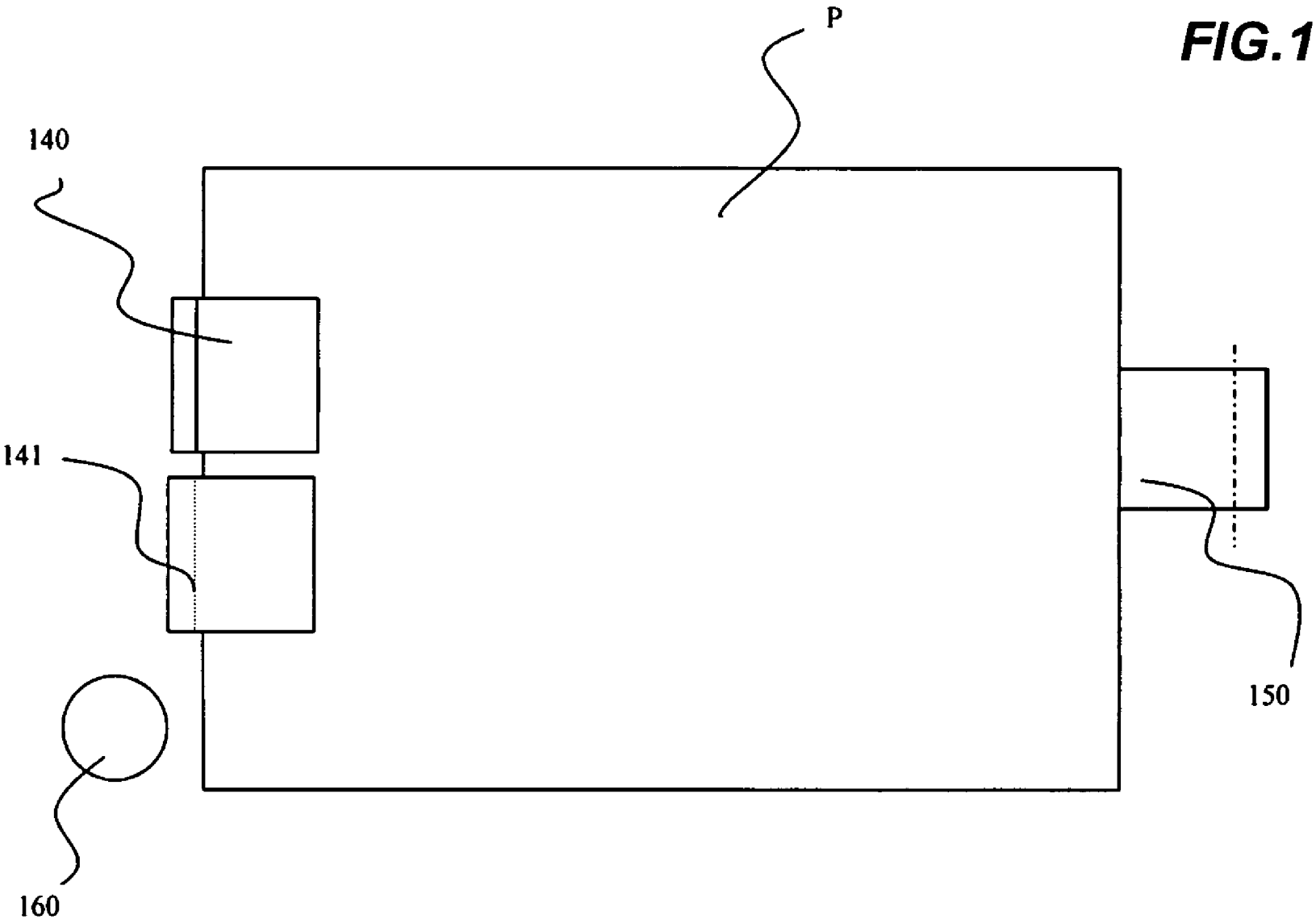
FIG. 11 is a plan view illustrating the configuration of the main part of the sheet processing apparatus according to the second embodiment.

As shown in FIGS. 10 and 11, a processing tray 130 is a sheet stacking portion that stacks sheets discharged by the first pair of discharge rollers. The sheets discharged onto the processing tray 130 are stacked in a sheet width direction by an aligning plate 140 and an attitude changing unit 150 which constitute a sheet bundle displacing unit (will be described later) such that sheet surfaces are partially exposed. At the same time, the sheets discharged on to the processing tray 130 are aligned by a rear end regulating plate 120 or the like in a sheet conveying direction. The sheets on the processing tray 130 are partially glued by an adhesion processing portion 101 (will be described later) to form a sheet bundle. The sheet bundle formed as described above is discharged onto a stack tray 199 by a pair of bundle discharge rollers 180 which can abut against each other and can be separated from each other.

A sheet bundle displacing unit and a sheet bundle aligning portion according to the embodiment will be described below. In FIGS. 10 and 11, on a one-end side of the processing tray 130 in the width direction, the aligning plate 140 having an oblique surface which can align and stack sheets P to align ends of sheets P to an approximately vertical line and an aligning plate 141 having a vertical surface which can align and stack the sheets P to substantially vertically align the ends of the sheets P are provided. The aligning plate 140 is held on the processing tray 130 such that the aligning plate 140 can be moved in an arrow direction (sheet width direction) and driven by a drive motors M1 and M2 through a drive transmitting portion (not shown). The aligning plate 141 is also held by the processing tray 130 such that the aligning plate 141 can be moved in directions of arrows, and the aligning plate 141 is driven by drive motor M2 through drive transmitting portions (not shown). On the other end side of the processing tray 130 in the width direction, the attitude changing unit 150 is provided. The attitude changing unit 150 includes an attitude changing pulley 150*a* and an attitude changing belt 150*c*. The attitude changing belt 150*c* is rotationally driven by a drive motor M4 through a drive transmitting portion (not shown). The attitude changing unit 150 is oscillated by a drive motor M5 through a drive transmitting portion (not shown) between a state in which a sheet abutting surface of the attitude changing belt 150*c* is substantially vertical and a state in which the sheet abutting surface is parallel to the oblique surface of the aligning plate 140. More specifically, the attitude changing unit 150 and the aligning plate 140 having the oblique surface function as sheet bundle displacing units which displace the sheets discharged onto the processing tray 130 such that sheet surfaces are partially exposed. The attitude changing unit 150 and the aligning plate 141 function as sheet bundle aligning portions that an adhesive glued sheet bundle on the processing tray 130 is aligned.

The adhesion processing portion 101 will be described below. In FIGS. 10 and 11, the adhesion processing portion 101 has an adhesive agent delivery device 160 which delivers a predetermined amount of adhesive agent from a delivery portion 160*a*. The adhesive agent delivery device 160 is a glue applying unit that applies an adhesive agent to the exposed parts of the sheet surfaces of the displaced and stacked sheet bundle on the processing tray 130. The adhesive agent delivery device 160 is moved by a drive motor M3 through a drive transmitting portion (not shown) in an arrow direction (direction along the exposed sheet surfaces of the displaced sheet bundle). Although not shown, the adhesion processing portion 101 is moved by a drive motor M6 (see FIG. 5) through a drive transmitting portion (not shown) in an arrow direction.

The motors M1 to M6, as in the above embodiment, are driven under the control of a CPU circuit portion serving as a controller on the basis of pieces of information of detection sensors S1 to S5. The CPU circuit portion has a CPU, a ROM, and a RAM built therein and integrally controls drivers of the motors M1 to M3 by a control program stored in the ROM. The RAM temporarily holds control data and is used as a work area of an arithmetic process based on the control.

In this case, a sheet adhering process (hereinafter, referred to as an adhesive sort mode hereinafter) performed in a sort mode will be described below.

As an entire process flow in the adhesive sort mode, a processing tray stacking step, an adhesion process step, and a bundle discharge step are sequentially performed. The bundle discharge step is the same as that in the embodiment, and a description thereof will be omitted. The processing tray stacking step and the adhesion process step will be described below.

In the processing tray stacking step, as described above, sheets P are sequentially discharged onto the processing tray 130 by a first pair of discharge rollers 7 through a pair of inlet rollers 16, a buffer roller 18, a second switching member 19, and a sort-mode path 22. The sheet P discharged onto the processing tray 130 begins to move to a rear end regulating plate 120 by the weight of the sheet P. In addition, a paddle (not shown) stopped at a home position is rotated to promote movement of the sheet P toward the rear end regulating plate 120. When the rear end of the sheet P in the sheet conveying direction reliably abuts against the rear end regulating plate 120 and stops, the rotation of the paddle also stops. Furthermore, the sheet P is aligned by the attitude changing unit 150 and the aligning plate 140 such that parts each having a predetermined amount of the sheet surfaces are exposed in a width direction orthogonal to the sheet conveying-in/out direction of the sheets. Each time a sheet is discharged onto the processing tray 130, the aligning operation is repeated. In this manner, the sheets discharged onto the processing tray 130 are displaced and stacked as shown in FIG. 10. More specifically, one of the two orthogonal sides of each sheet is aligned and supported by the rear end regulating plate 120, and the sheets are aligned and stacked by the aligning plate 140 and the attitude changing unit 150 so as to shift the sheets from each other by a predetermined amount.

The adhesion process step will be described below with reference to FIGS. 12A to 12D.

Figure 12A:
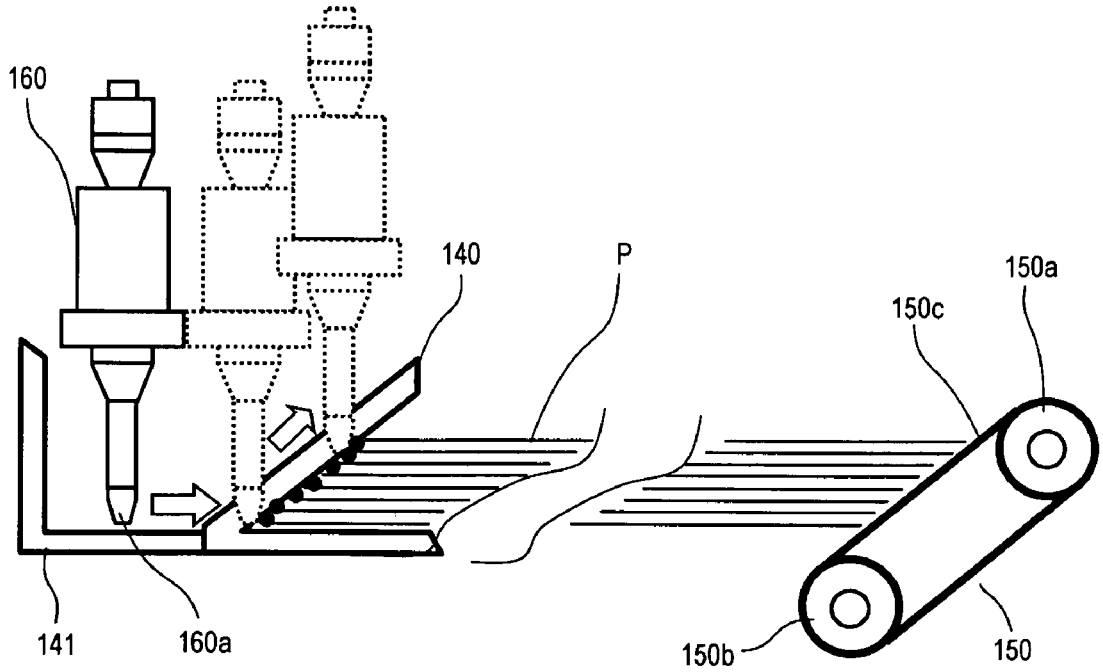
FIG. 12A is a sectional view illustrating an operating state of an adhesion process step of the sheet processing apparatus according to the second embodiment.

When the sheets P are completely stacked on the processing tray 130 as described above such that ends of the sheets P are shifted from each other by a predetermined amount, the drive motor M3 is driven to drive the adhesive agent delivery device 160. The adhesive agent delivery device 160 delivers a predetermined amount of adhesive agent to the exposed parts of the sheet surfaces of a predetermined number of uniformly spread sheets while moving along the ends of the sheet bundle P the attitude of which is obliquely changed. In the movement of the adhesive agent delivery device 160, when the uppermost sheet P is detected by a detecting portion (not shown), the adhesive agent delivery device 160 is stop not to deliver the adhesive agent to the uppermost sheet, and the delivery process is completed (FIG. 12A).

Figure 12B:
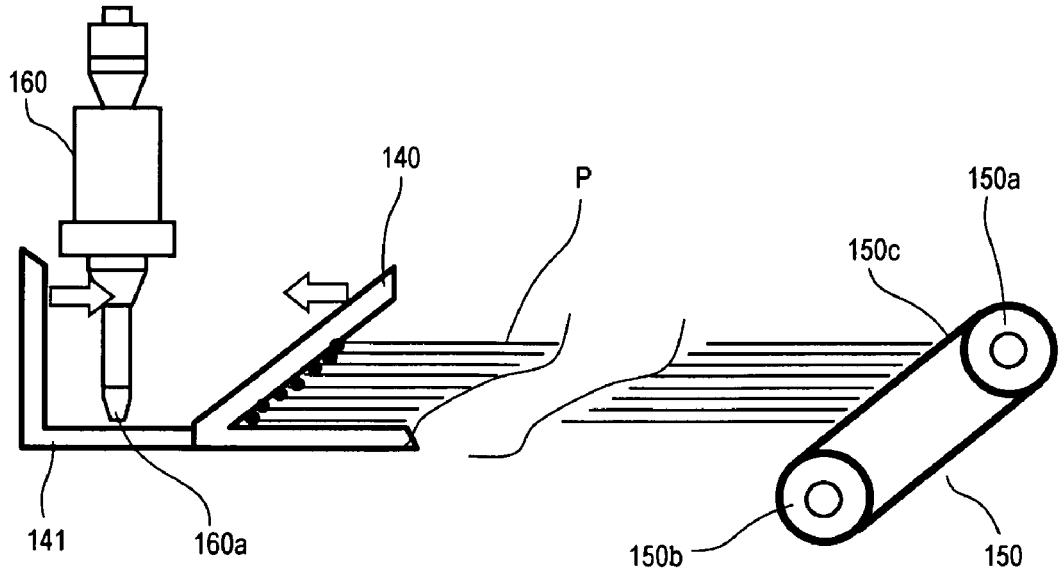
FIG. 12B is a sectional view illustrating an operating state of the adhesion process step of the sheet processing apparatus according to the second embodiment.

Upon completion of the delivery process of the adhesive agent, the drive motor M1 is driven, and as shown in FIG. 12B, the aligning plate 140 is retreated from an abutting state, and the aligning plate 141 enters the sheet bundle by a predetermined amount to be replaced with the aligning plate 140.

Figure 12C:
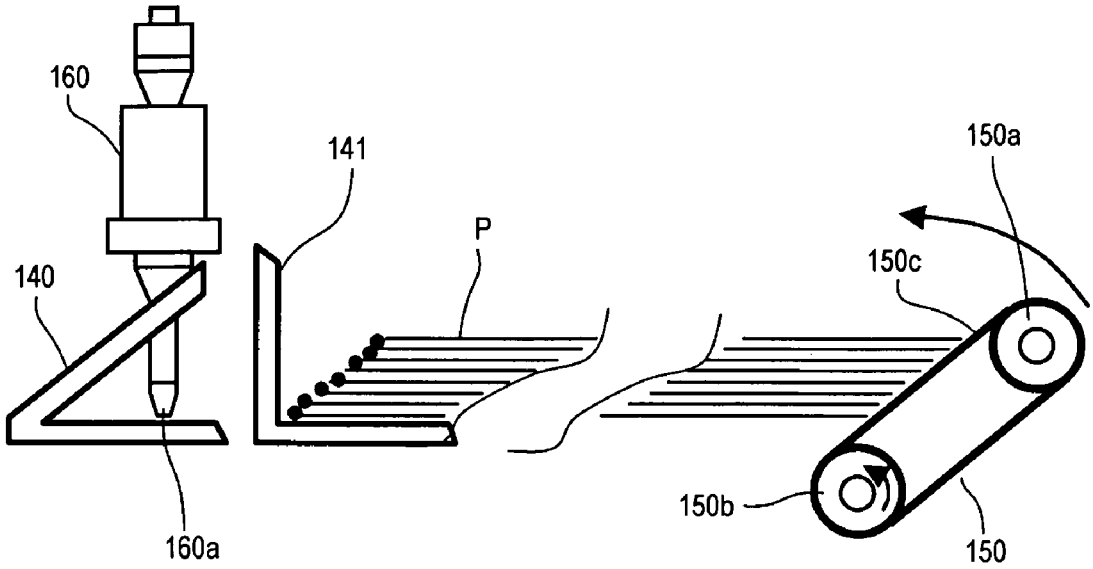
FIG. 12C is a sectional view illustrating an operating state of the adhesion process step of the sheet processing apparatus according to the second embodiment.
Figure 12D:
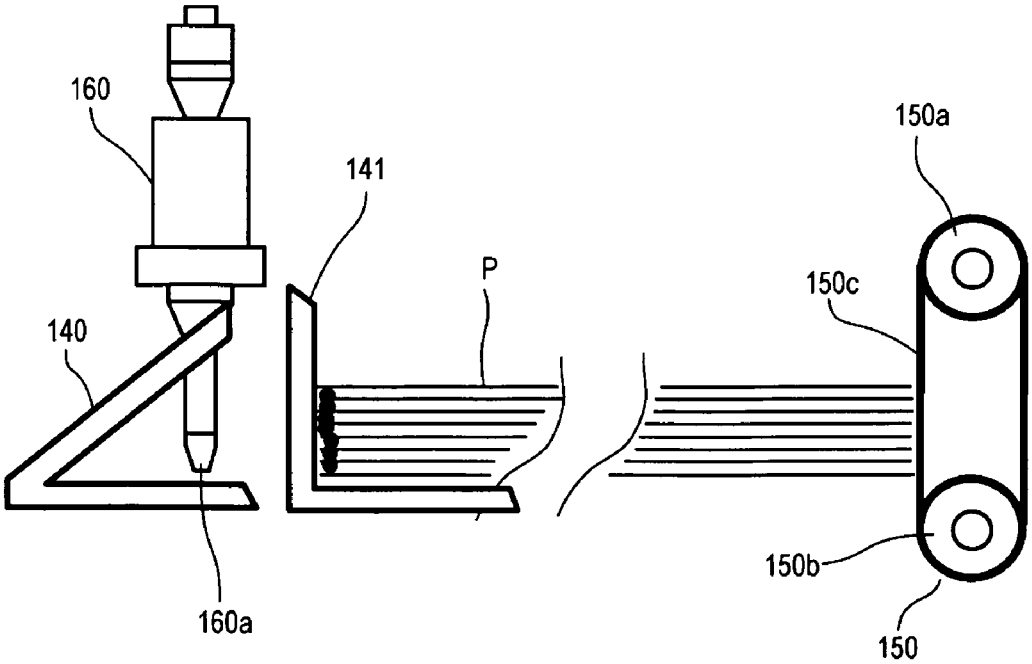
FIG. 12D is a sectional view illustrating an operating state of the adhesion process step of the sheet processing apparatus according to the second embodiment.

The attitude changing unit 150 is oscillated such that the sheet abutting surface of the attitude changing belt 150*c* is substantially vertical and thereby pressing each sheet toward the aligning plate 141 side (FIG. 12C). The attitude changing unit 150 aligns the sheet bundle together with the aligning plate 141 such that an end surface of the sheet bundle is substantially vertical (FIG. 12D). In this manner, the sheet bundle is set in a state that two orthogonal sides of each sheet are aligned.

As described above, according to the embodiment, each time a sheet is discharged onto the processing tray 130, the attitude is changed, and an adhesive agent is applied to the sheet surfaces exposed by the change in attitude collectively. With this process, an amount of application of the adhesive agent to the sheets can be stabilized. Adhesive force between the sheets can also be stabilized. Furthermore, in comparison with the first embodiment, the productivity of the glued sheet bundle can be more improved.

Third Embodiment

Figure 13:
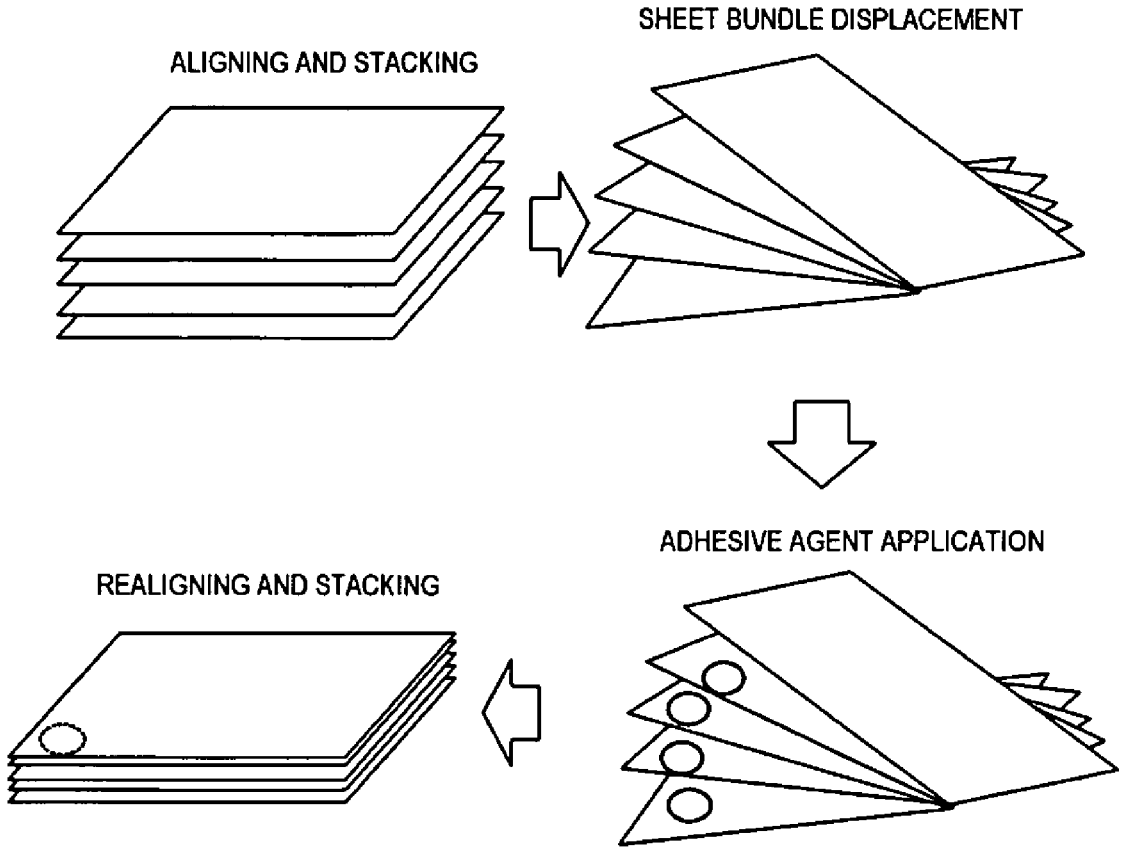
FIG. 13 is an explanatory view illustrating a flow of an operation of a sheet processing apparatus according to a third embodiment by a sheet stacking state.

In the first and second embodiments, in a stacking state of a sheet bundle in application of an adhesive agent, the sheet bundle is stacked such that one side of two orthogonal sides of sheets are on the same plane and the other sides are shifted from each other by a predetermined amount, so that an adhesive agent application region is assured. However, the present invention is not limited to the embodiments. For example, as shown in FIG. 13, by a sheet bundle displacing unit, the sheets are rotationally displaced about one corner of the aligned sheet bundle to shift the sheets by a predetermined amount in the rotating direction, so that the application region of the adhesive agent can also be assured. For example, one corner of an aligned sheet bundle is vertically nipped by one pair of nipping members serving as a sheet bundle displacing unit and having a large friction coefficient, and any one of the upper and lower nipping members is rotated to shift the sheets of the sheet bundle by a predetermined amount in the rotating direction. Any one of the upper and lower nipping members is reversely rotated after the adhesive agent is applied, and an end surface of the sheet bundle is caused to abut against a stopper provided as a reference to obtain an alignment state.

In addition, the sheet bundle is curved such that one end of the sheet bundle is nipped, so that the other end side is shifted by a predetermined amount in relation to the circumference. When the sheet bundle having the same amount in the circumference direction is curved, the other end of an inner sheet having a small curvature radius, opposing the nipped end shifts to be exposed from the other end of an outer sheet. The exposed part is assured as an adhesive agent applied region. A curved state of the sheet bundle is canceled after the adhesive agent is applied to obtain an alignment state.

In the embodiment described above, the copying machine is illustrated as an image forming apparatus. However, the present invention is not limited to the copying machine. For example, another image forming apparatus such as a printer or a fax machine or another image processing apparatus such as a complex machine obtained by combining these functions may be used. The present invention is applied to a sheet processing apparatus used in these image forming apparatuses to enable to obtain the same effect as described above.

In the embodiment described above, the sheet processing apparatus connected to the image forming apparatus is illustrated. However, the present invention is not limited to the embodiment. For example, a sheet processing apparatus integrally included in the image forming apparatus may be used, the same effect can be obtained by applying the present invention to the sheet processing apparatus.

Fourth Embodiment

A fourth embodiment of the present invention will be described below with reference to the accompanying drawings. An image forming apparatus comprising a sheet processing apparatus will be described below. A simplified bookbinding device will be illustrated as the sheet processing apparatus, and a printer will be illustrated as the image forming apparatus.

Figure 14:
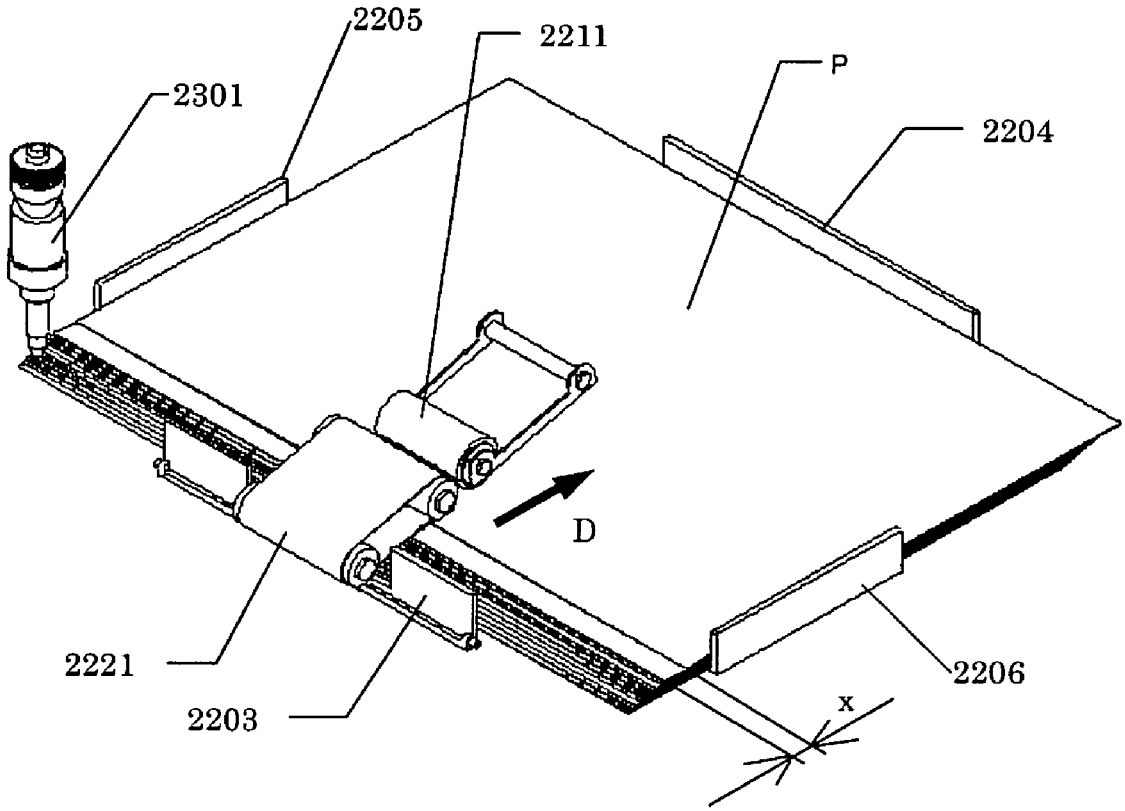
FIG. 14 is a perspective view illustrating a state in which sheets are shifted in a simplified bookbinding device according to a fourth embodiment.
Figure 15:
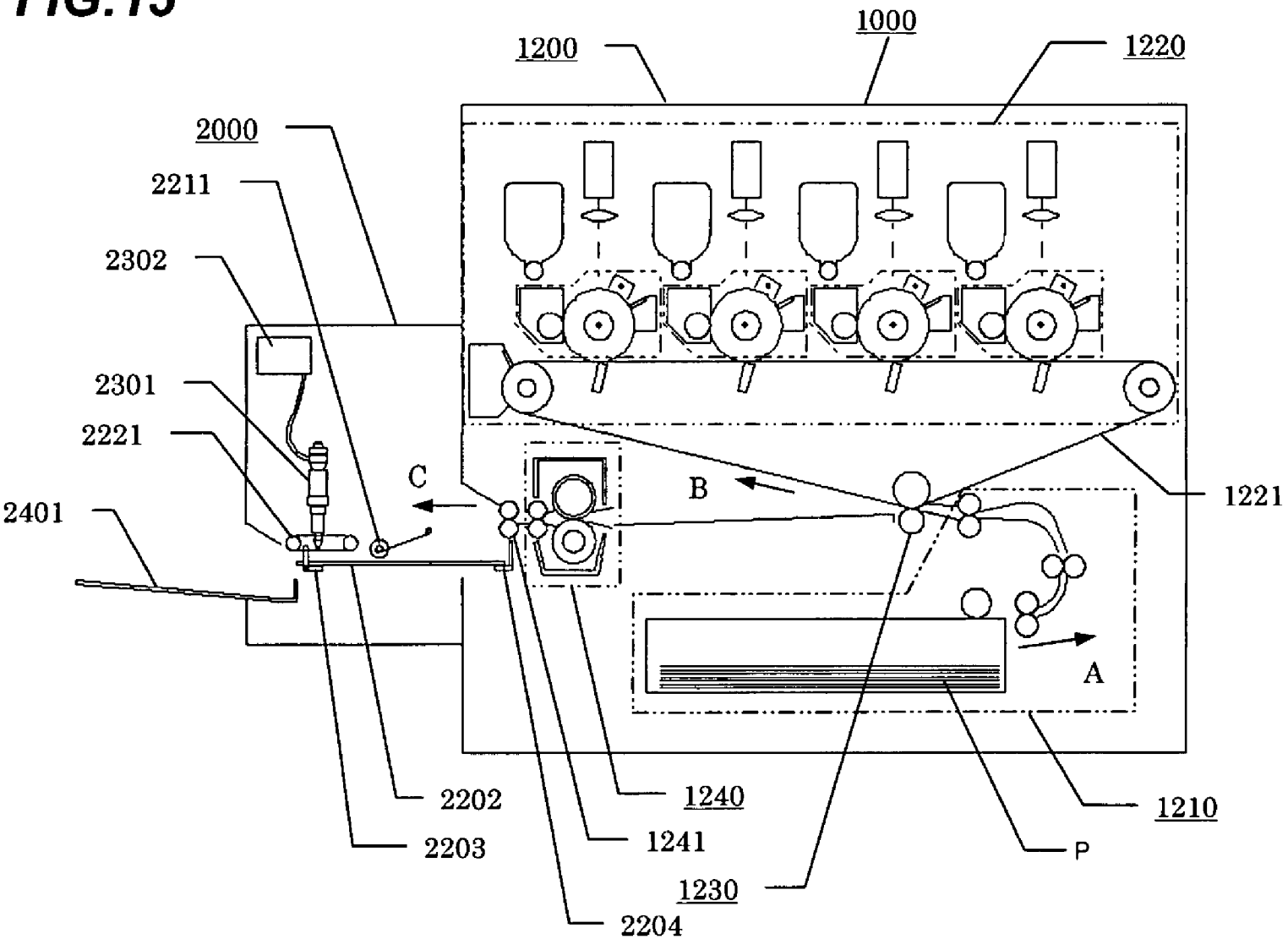
FIG. 15 is a sectional view illustrating a schematic configuration of an image forming apparatus having the simplified bookbinding device according to the fourth embodiment.
Figure 17:
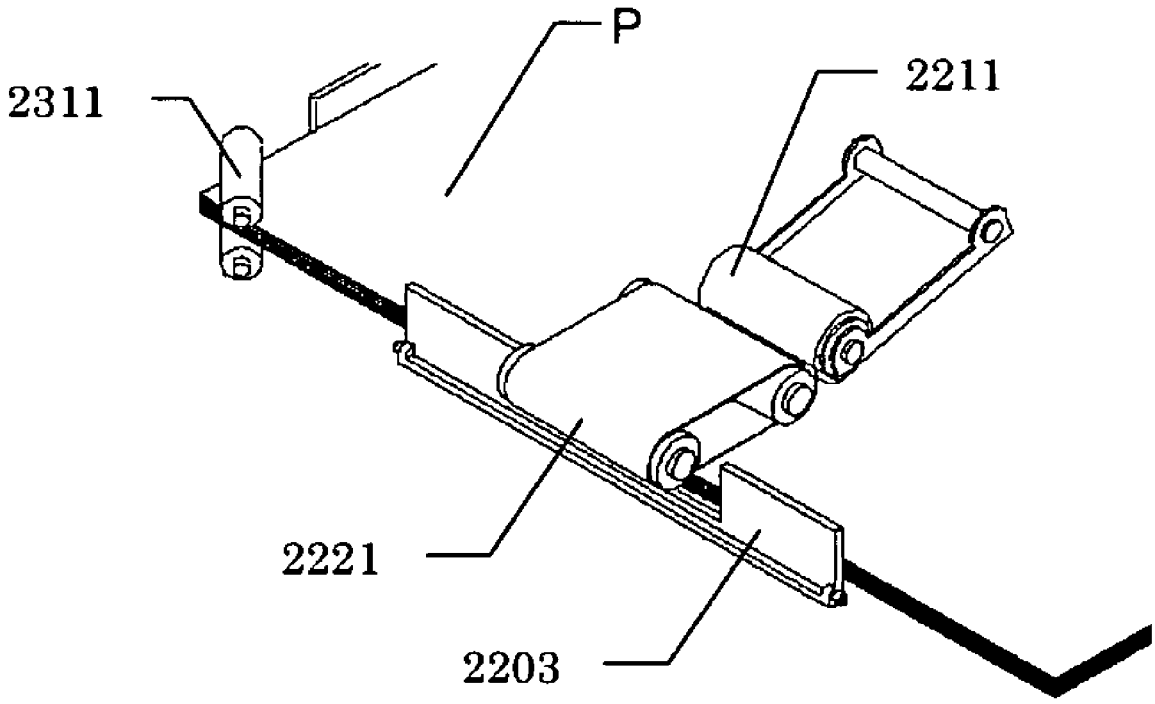
FIG. 17 is a perspective view illustrating a state in a sheet pressing state in the simplified bookbinding device according to the fourth embodiment.
Figure 18:
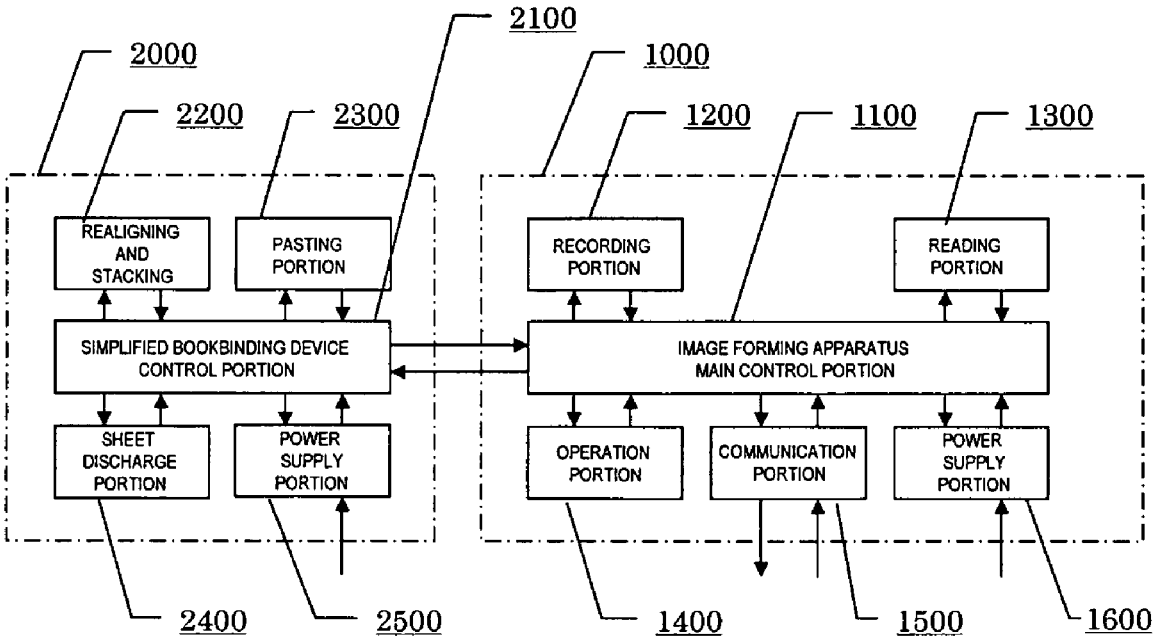
FIG. 18 is a block diagram illustrating a system configuration of an entire apparatus in the simplified bookbinding device according to the fourth embodiment.
Figure 19:
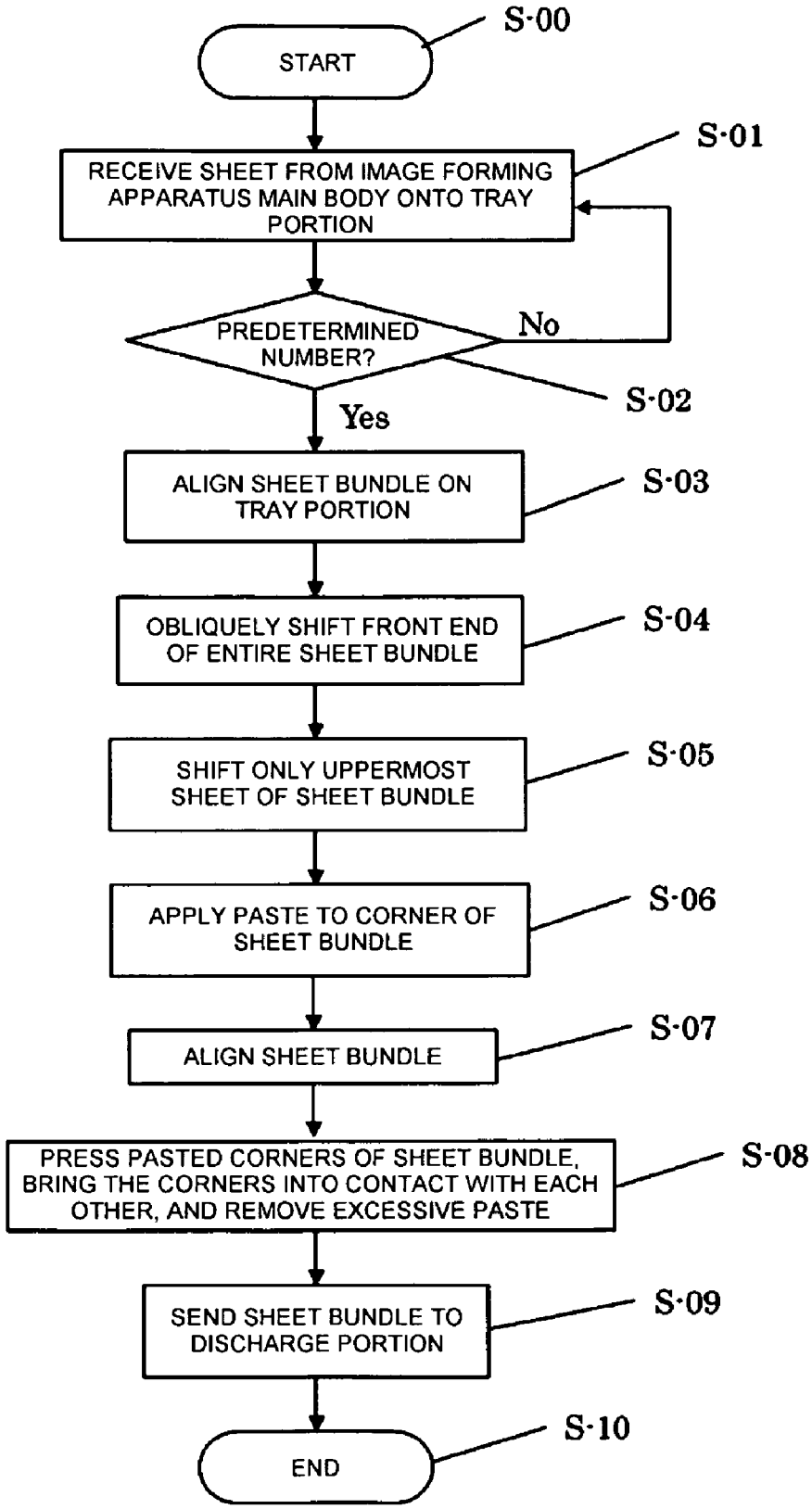
FIG. 19 is a flowchart illustrating an order of pasting operations which glue a predetermined number of sheets in the simplified bookbinding device according to the fourth embodiment.

FIG. 14 is a perspective view illustrating a state in which a sheet bundle is glued such that an uppermost sheet of the sheet bundle is largely shifted in the simplified bookbinding device according to the fourth embodiment. FIG. 15 is a sectional view illustrating a main structure of the simplified bookbinding device and an image forming apparatus to which the simplified bookbinding device is connected. FIGS. 16A to 16G are process explanatory views for explaining pasting steps for a sheet bundle in the simplified bookbinding device. FIG. 17 is a perspective view illustrating a state in which sheets are pressed after pasting to complement FIG. 16. FIG. 18 is a block diagram illustrating a system configuration of the image forming apparatus and the simplified bookbinding device. FIG. 19 is a diagram illustrating pasting steps by a flowchart.

Structures of a recording portion 1200 of an image forming apparatus main body 1000 and a simplified bookbinding device 2000 will be described below with reference to FIG. 15. In FIG. 15, in a sheet supply portion 1210 in the recording portion 1200 of the image forming apparatus main body 1000, a plurality of (several hundreds or several thousands) quadrangular sheets P are stored in a stacked state, separated one by one, and conveyed in a direction of arrow A.

An imaging portion 1220 causes a colored fine-grain toner to adhere to a transfer belt 1221 serving as an endless belt rotating in a direction of arrow B depending on image information of digital data. A transfer portion 1230 transfers a toner image of the transfer belt 1221 on which the toner image is formed by the imaging portion 1220 to sheets P separated and conveyed one by one from the sheet supply portion 1210. A fixing portion 1240 fixes the toner image transferred to the sheet by the transfer portion 1230 to the sheet P.

A pair of handover rollers 1241 serving a sheet discharge portion is provided on a downstream side of the fixing portion 1240 in a conveying direction. After the sheet P passes through the fixing portion 1240, the sheet P is conveyed by the pair of handover rollers 1241 in a direction of arrow C and handed over to the simplified bookbinding device 2000.

In this case, the reader portion 200 will be described below with reference to FIGS. 14 and 15. In FIG. 15, a stacking tray 2202 serves as a sheet stacking portion. The stacking tray 2202 stacks sheets P sequentially sent from the pair of handover rollers 1241 of the recording portion 1200.

In FIGS. 14 and 15, a front-end aligning plate 2203 aligns the front-end side of the sheet P placed on the stacking tray 2202 in a conveying direction, or moves a bundle of sheets P in the conveying direction on the stacking tray 2202. A rear-end aligning plate 2204 aligns a rear-end side of the sheet P placed on the stacking tray 2202 in the conveying direction or moves the bundle of the sheets P on the stacking tray 2202 in the conveying direction. By the front-end aligning plate 2203 and the rear-end aligning plate 2204, alignment is performed in the sheet conveying direction. Width aligning plates 2205 and 2206 align the sheets in a width direction orthogonal to the conveying direction of the sheet. These aligning plates are sheet aligning portions that two orthogonal sides of each sheet on the stacking tray 2202.

A shift belt unit 2221 includes an endless belt and rollers across which the endless belt is bridged and rotationally driven, and is provided on a forward-end side of the bundle of sheets P placed on the stacking tray 2202 in the conveying direction. The shift belt unit 2221 moves from a standby position where the shift belt unit 2221 is not engaged with the bundle of sheets P to a position where the shift belt unit 2221 is engaged with the forward end of the bundle of sheets P while rotating the endless belt to be obliquely pressed back toward the rear-end side of the sheet P. In this manner, the shift belt unit 2221 shifts the sheets P of the bundle by a predetermined amount. The shift belt unit 2221 is a sheet bundle displacing unit that displaces the aligned bundle of sheets P on the stacking tray 2202 to partially expose the sheet surfaces.

A shift belt unit 2221 is a sheet shifting unit that shifts only the uppermost sheet on the stacking tray 2202 more largely than the other sheets. The shift roller 2211 moves from a standby position in which the shift roller 2211 is not engaged with the uppermost sheet P of the sheet bundle stacked on the stacking tray 2202 to a position where the shift roller 2211 is engaged with the uppermost sheet P of the sheet bundle to shift only the uppermost sheet before the pasting or immediately after the pasting. The shift roller 2211 also functions to convey the bundle of sheets P the glued parts of which are fixed.

A glue injecting portion 2301 is a glue applying unit that applies a glue to exposed parts of the sheet surfaces of the bundle of sheets P displaced on the stacking tray 2202. In this case, the glue injecting portion 2301 is provided on the front-end side of the bundle of sheets P placed on the stacking tray 2202 in the conveying direction, and injects a predetermined amount of liquid glue to corners of the sheets to be glued. A glue supply portion 2302 supplies a liquid glue to the glue injecting portion 2301 and retains the liquid glue. The glue injecting portion 2301 includes a glue injection state detecting portion or the like that detects that an incomplete injection state is caused by hardening the glue at an injection port. The glue injecting portion 2301 includes a past-remaining-amount detecting portion that detects an amount of retained glue, a glue supply unit to supply a glue from the outside, and the like. A discharge tray 2401 receives the glued sheets P when the sheets P are discharged out of the apparatus.

The configuration of the recording portion 1200 is not limited to the configuration as described above. Any image forming apparatus that can give a sheet to the simplified bookbinding device 2000, exchange a control signal, and perform a cooperative operation can be used.

A system configuration of the image forming apparatus main body 1000 and the simplified bookbinding device 2000 will be described below with reference to FIG. 18. In FIG. 18, an image forming apparatus main control portion 1100 controls respective components of the image forming apparatus main body 1000 by a control signal. The image forming apparatus main control portion 1100 includes a storage portion that stores control information and various data, an arithmetic operation portion (CPU) that generates a control signal on the basis of the control information or performs an arithmetic process to the digital data, and the like. The image forming apparatus main control portion 1100 is connected to the recording portion 1200 that forms an image on a sheet and a reading portion 1300 that converts image information on a sheet or the like into an electric signal to obtain digital data and read the digital data. The image forming apparatus main control portion 1100 is connected to an operation portion 1400 in that the number of recording sheets, start of recording, start of reading, and the like are designated by an operator of the apparatus and a communication portion 1500 that transmits and receives image data to/from a device outside the apparatus through a network or the like. Furthermore, the image forming apparatus main control portion 1100 is connected to a power supply portion 1600 that supplies power to the respective components. The image forming apparatus main control portion 1100 integrally controls the above components. An arrow in FIG. 18 indicates a flow of a control signal or power.

In FIG. 18, a simplified bookbinding device control portion 2100 controls the respective components of the simplified bookbinding device 2000. The simplified bookbinding device control portion 2100 of the simplified bookbinding device 2000 exchanges a control signal with the image forming apparatus main control portion 1100 of the image forming apparatus main body 1000 to synchronize the operations of the components. The simplified bookbinding device control portion 2100 is connected to a sheet aligning portion 2200 of the simplified bookbinding device 2000, a pasting portion 2300 of the simplified bookbinding device 2000, a sheet discharge portion 2400 of the simplified bookbinding device 2000, and a power supply portion 2500 that supplies power to the components of the simplified bookbinding device 2000 to control the respective components. The sheet aligning portion 2200 includes the stacking tray 2202, the front-end aligning plate 2203, the rear-end aligning plate 2204, the shift roller 2211, and the shift belt unit 2221. The pasting portion 2300 includes the glue injecting portion 2301, the glue supply portion 2302, and a glued-part pressing member 2311 (will be described later). More specifically, the simplified bookbinding device control portion 2100 controls an operation of the front-end aligning plate 2203 and the rear-end aligning plate 2204, and operation of the shift roller 2211 and the shift belt unit 2221, an operation of the glue injecting portion 2301 and the glue supply portion 2302, an operation of the glued-part pressing member 2311 (will be described later), and the like. The sheet discharge portion 2400 includes the discharge tray 2401.

Steps of pasting a corner of each sheet of a sheet bundle will be described below with reference to FIGS. 16A to 16G, FIG. 14 and FIG. 17.

Figure 16A:
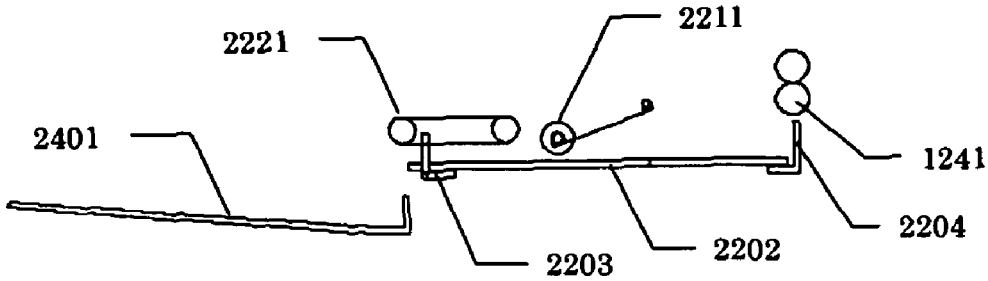
FIG. 16A is an explanatory view of a sheet pasting step in the simplified bookbinding device according to the fourth embodiment.

FIG. 16A illustrates a standby state before a sheet is sent from the recording portion 1200 of the image forming apparatus main body 1000 to the simplified bookbinding device 2000.

Figure 16B:
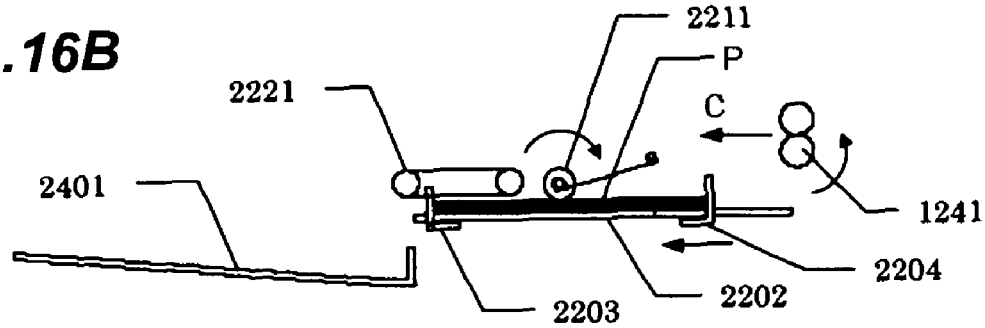
FIG. 16B is an explanatory view of a sheet pasting step in the simplified bookbinding device according to the fourth embodiment.

FIG. 16B illustrates a state in which the sheet P is sent from the recording portion 1200 of the image forming apparatus main body 1000 to the simplified bookbinding device 2000. At this time, the pair of handover rollers 1241 and the shift roller 2211 are rotated in a direction of arrow C which is a conveying direction, and the sheets P are sequentially stacked on the stacking tray 2202. When the number of sheets P stacked on the stacking tray 2202 reaches a predetermined number, the front-end aligning plate 2203, the rear-end aligning plate 2204, and the width aligning plates 2205 and 2206 (see FIG. 14) are cooperated to align the sheets such that the sides of the quadrangular sheets P are aligned. In this case, the predetermined number of sheets is the number of sheets of one bundle to be glued.

Figure 16C:
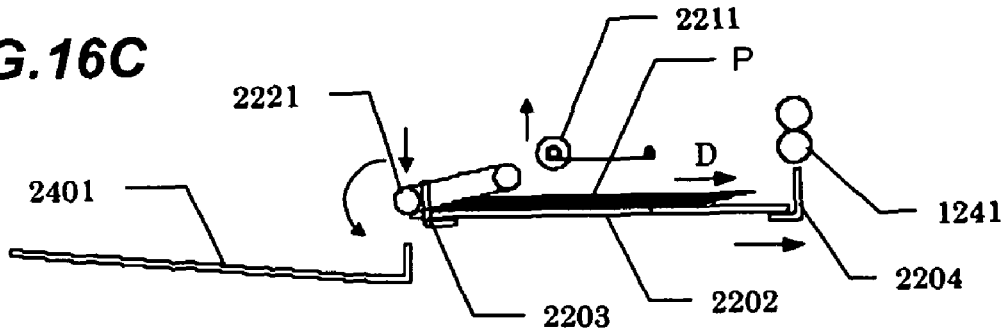
FIG. 16C is an explanatory view of a sheet pasting step in the simplified bookbinding device according to the fourth embodiment.

In FIG. 16C, the shift roller 2211 and the rear-end aligning plate 2204 are retreated to a position where the shift roller 2211 and the rear-end aligning plate 2204 are not engaged with the sheet P. Thereafter, the shift belt unit 2221 is engaged with the bundle of sheets P the four sides of which are aligned such that front-end sides in the conveying direction is obliquely pressed from above. Herewith, the shift belt unit 2221 is rotated such that the sheets are pressed backward in a direction of arrow D, which opposes the direction in which the sheets, are sent. In this manner, the bundle of sheets P is set in a state in that the stacked sheets are sequentially shifted from the uppermost sheet by a predetermined amount (several millimeters).

Figure 16D:
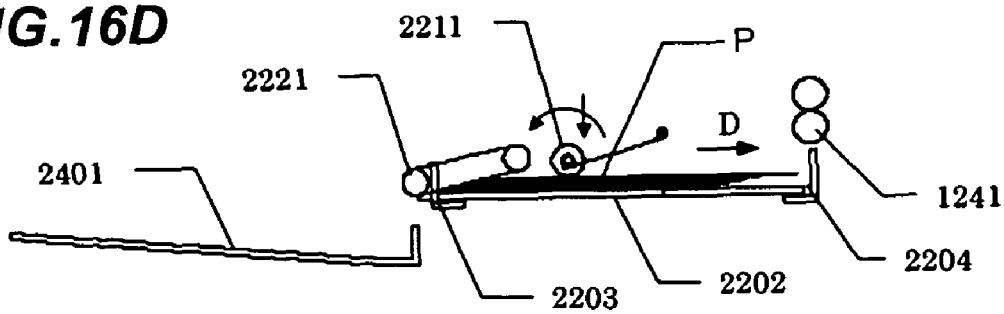
FIG. 16D is an explanatory view of a sheet pasting step in the simplified bookbinding device according to the fourth embodiment.

In FIG. 16D, the rotation of the shift belt unit 2221 is stopped. Thereafter, the shift roller 2211 is engaged with the uppermost sheet of the bundle of sheets P again and rotated in a direction to move the sheets in the direction of arrow D. In this manner, only the uppermost sheet is shifted largely more than the other sheets. In this case, only the uppermost sheet is moved by several centimeters in the direction of arrow D. This state is illustrated as a perspective view in FIG. 14. The bundle of sheets P is set in a state in which all the front-end sides in the conveying direction are obliquely shifted. Furthermore, only the uppermost sheet is moved to a position shifted by a shift distance x larger than a shift amount of the sheet under the uppermost sheet.

Figure 16E:
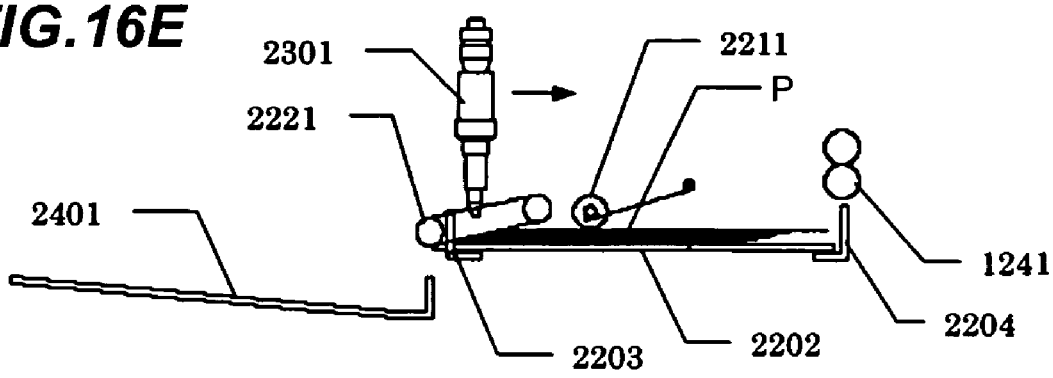
FIG. 16E is an explanatory view of a sheet pasting step in the simplified bookbinding device according to the fourth embodiment.

In FIG. 16E, the glue injecting portion 2301 is moved from a standby position to a position where a glue as shown in FIG. 14 is injected to glue the corners of the sheets P. Furthermore, the glue injecting portion 2301 injects a proper amount of glue to predetermined corners of the sheets while supplying a liquid glue from the glue supply portion 2302 and being moved to a position where no glue adheres to the uppermost sheet.

Figure 16F:
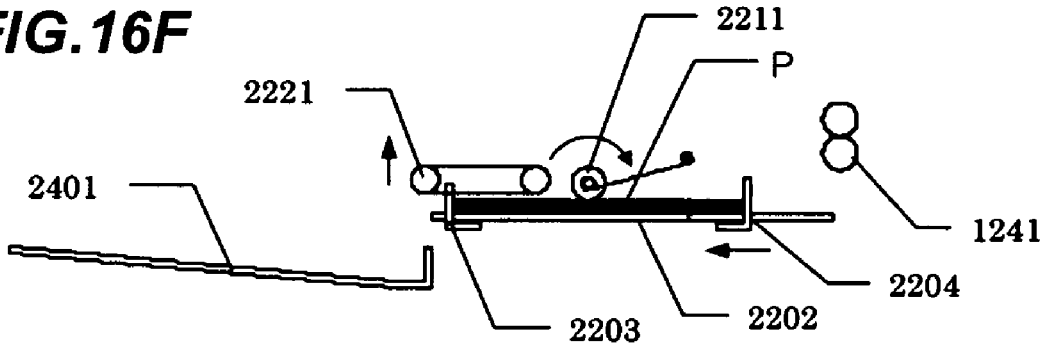
FIG. 16F is an explanatory view of a sheet pasting step in the simplified bookbinding device according to the fourth embodiment.

In FIG. 16F, the shift belt unit 2221 is moved to a standby position where the shift belt unit 2221 is not engaged with the sheet P. Thereafter, the shift roller 2211 is rotated in the same direction in which the sheets are sent from the pair of handover rollers 1241 while being engaged with the uppermost sheet P of the sheet bundle. At the same time, the rear-end aligning plate 2204 is moved so as to press the rear-ends of the bundle of sheets P in the conveying direction. In this manner, the conveying-direction front-end side of the bundle of sheets P having corners to which the glue adheres except for the uppermost sheet is aligned to the front-end aligning plate 2203 again. More specifically, the shift roller 2211, the rear-end aligning plate 2204, and the front-end aligning plate 2203 function as a sheet bundle aligning portion that sets the bundle of glued sheets P on the stacking tray 2202 in a state in which two orthogonal sides of each sheet are aligned to adhere the sheets of the bundle to each other. The bundle of sheets P including the uppermost sheet to which the glue does not adhere is aligned to adhere the sheets P of the bundle to each other. At this time, the glue does not adhere to the upper surface side of the uppermost sheet, and the lower surface side is brought into contact with the glue adhering to the sheet immediately under the uppermost sheet to adhere to the sheet. In this state, as shown in FIG. 17, a corner of the glued sheets P is nipped and pressed by the glued-part pressing member 2311 which constitutes a pressing portion. In this manner, the sheets of the bundle of sheets P are brought into press contact with each other to increase adhesive force, and excessive glue is removed. In this case, when the glue is not easily dried, a glue-drying unit that sends air or applies heat may be additionally provided.

Figure 16G:
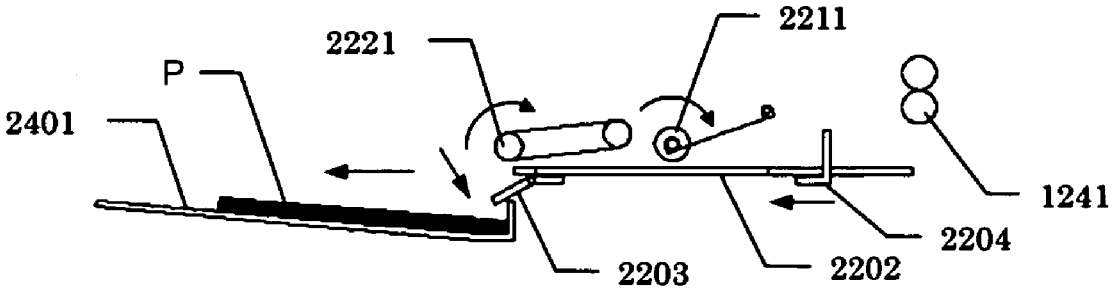
FIG. 16G is an explanatory view of a sheet pasting step in the simplified bookbinding device according to the fourth embodiment.

In FIG. 16G, the front-end aligning plate 2203 is opened, the glued and aligned bundle of sheets P is pressed by the rear-end aligning plate 2204. At this time, the shift roller 2211 and the shift belt unit 2221 are brought into contact with the bundle of sheets P to be rotated in a direction in which the bundle is sent toward the discharge tray 2401. In this manner, the bundle of sheets P is discharged from the upper side of the stacking tray 2202 to the upper side of the discharge tray 2401.

The sheet pasting steps described with reference to FIGS. 16A to 16G, FIG. 14, and FIG. 17 will be described below again by using the flowchart in FIG. 19. In FIG. 19, the pasting step is started in step S-00. In step S-01, the sheets P sent by the pair of handover rollers 1241 in the recording portion 1200 of the image forming apparatus main body 1000 is received onto the stacking tray 2202. In step S-02, under the cooperative control of the image forming apparatus main control portion 1100 and the simplified bookbinding device control portion 2100, the number of sheets P stacked on the stacking tray 2202 is detected, and the simplified bookbinding device control portion 2100 determines whether the number of sheets P reaches a predetermined number. When the simplified bookbinding device control portion 2100 determines in step S-02 that the number of sheets P does not reach the predetermined number, the simplified bookbinding device control portion 2100 returns to step S-01 to repeat the step until the number of sheets P reaches the predetermined number. When the simplified bookbinding device control portion 2100 determines that the number of sheets P reaches the predetermined number, the simplified bookbinding device control portion 2100 shifts to step S-03. Although not shown, when the predetermined number is 1, or when an operator selects a setting such that pasting is not performed, the simplified bookbinding device control portion 2100 is controlled not to perform the pasting step.

In step S-03, the simplified bookbinding device control portion 2100 controls an operation in that the rear-end aligning plate 2204 abuts against the rear end and the side end of the bundle of sheets P in the conveying direction such that the front end and the side end of the bundle of sheets P in the conveying direction on the stacking tray 2202 are aligned to the front-end aligning plate 2203.

In step S-04, the shift belt unit 2221 is obliquely engaged with the front end side of the bundle of sheets P in the conveying direction on the stacking tray 2202 from above. The simplified bookbinding device control portion 2100 controls the operation of the shift belt unit 2221 such that the bundle of sheets P is entirely obliquely shifted by several millimeters by rotation in a direction opposing the conveying direction.

In step S-05, the shift roller 2211 is engaged the uppermost sheet P of the sheet bundle entirely obliquely shifted by several millimeters in step S-04. An operation in that rotation is performed such that only the uppermost sheet further moves by several centimeters in the direction opposing the conveying direction.

In step S-06, a glue is injected from the glue injecting portion 2301 to a predetermined position (sheet surfaces exposed by the shifting operation) of the sheets except for the uppermost sheet largely shifted in step S-05 while a liquid glue is appropriately supplied from the glue supply portion 2302 to the glue injecting portion 2301. At this time, a supply timing and a supply amount of the glue of the glue supply portion 2302, a position of the glue injecting portion 2301, an injection timing, an injection amount, and the like are controlled by the simplified bookbinding device control portion 2100 such that an appropriate amount of glue injected from the glue injecting portion 2301 adheres to the position.

In step S-07, the front end and the side end of the bundle of sheets P (except for the uppermost sheet) on which a glue adheres to the predetermined position in step S-06 are moved to be aligned to the front-end aligning plate 2203 such that the rear-end aligning plate 2204 presses the rear end and the side end of the bundle of sheets P in the conveying direction. At the same time, the shift roller 2211 is rotated in such a direction that the bundle of sheets P is conveyed toward the front-end aligning plate 2203. At this time, the shift belt unit 2221 is retreated from the bundle of sheets P. These operations are controlled by the simplified bookbinding device control portion 2100.

In step S-08, the part glued in step S-06 in the bundle of sheets P aligned in step S-07 is pressed by the glued-part pressing member 2311. In this manner, the sheets are brought into press contact with each other to increase adhesive force, and an excessive glue is removed. In this manner, the simplified bookbinding device control portion 2100 controls the operation of the glued-part pressing member 2311.

In step S-09, the bundle of sheets P the glued portions of which are brought into press contact with each other in step S-08 and from which the excessive glue is removed is discharged onto the discharge tray 2401. The front-end aligning plate 2203 is opened such that the rear-end aligning plate 2204 presses the rear end and the side end of the bundle of sheets P in the conveying direction, and the shift roller 2211 and the shift belt unit 2221 are engaged with the bundle of sheets P and rotated in such a direction that the bundle of sheets P is conveyed. In this manner, the simplified bookbinding device control portion 2100 controls the respective components. With this process, the glued bundle of sheets P is moved from the stacking tray 2202 and discharged onto the discharge tray 2401. In step S-10, the step of pasting a predetermined number of sheets is ended. When the sheet bundle is continuously glued, the simplified bookbinding device control portion 2100 returns to step S-00 to cause the simplified bookbinding device control portion 2100 to repeat the control of one series of steps.

In the simplified bookbinding device 2000 constructed in combination with the image forming apparatus main body 1000, a predetermined number of sheets output from the image forming apparatus are stacked to obtain a bundle, and only the uppermost sheet is largely shifted to glue corners of the bundle sheets. In this manner, the sheet bundle is stapled while preventing the glue from adhering to the upper surface of the uppermost sheet, so that a product like a simple book, which can be handled as a booklet independently of other sheet bundles, can be formed. The corners of the sheets are glued in the embodiments described above to obtain a product equivalent to a product stapled at one point in a stapling process. However, the product is not limited to the above products. For example, in a state in which one side of each sheet is shifted, regions along one side of exposed sheet surfaces are glued to obtain a product equivalent to a product stapled at two positions in the stapling process.

Fifth Embodiment

A fifth embodiment of the present invention will be described below with reference to the drawings. Parts common to those in the fourth embodiment will be appropriately omitted.

Figure 20:
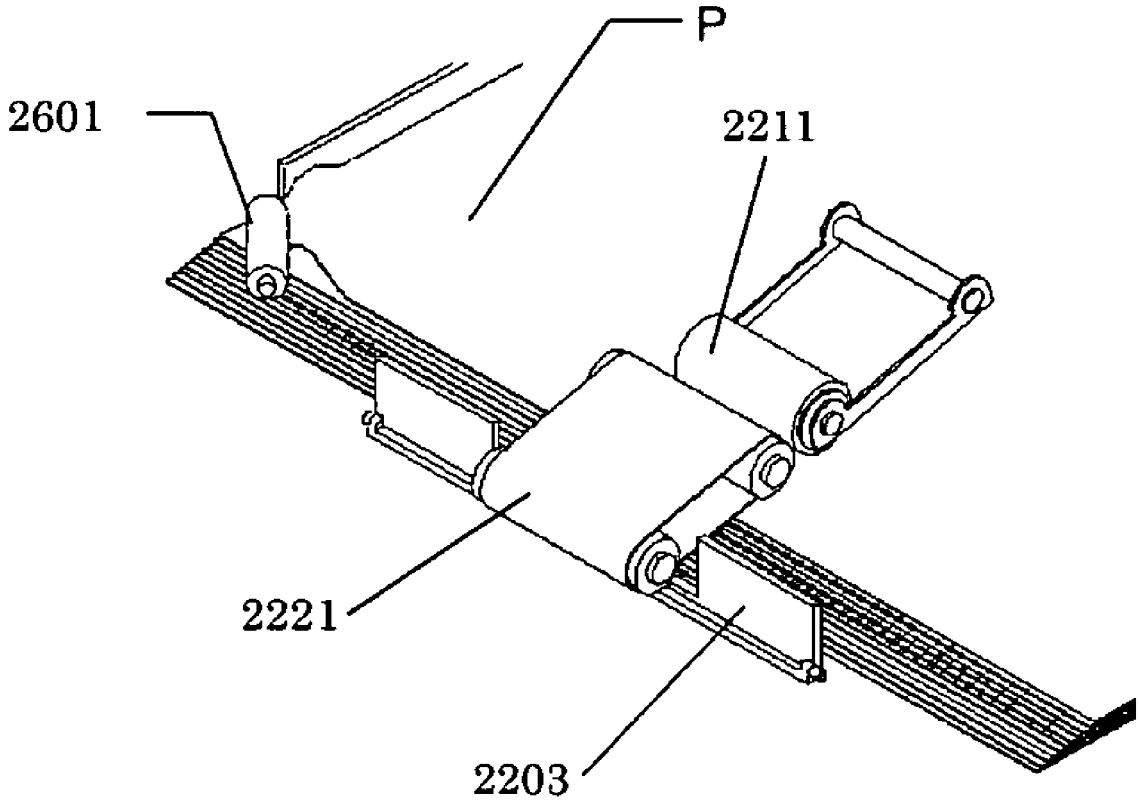
FIG. 20 is a perspective view for explaining an operation which shifts a corner of a sheet in a simplified bookbinding device according to a fifth embodiment of the present invention.

FIG. 20 is a perspective view illustrating a state immediately before corners of the sheets P stacked on a stacking tray 2202 are glued in a simplified bookbinding device according to the fifth embodiment. As shown in FIG. 20, a front-end side of a bundle of sheets P on the stacking tray 2202 in the conveying direction is obliquely shifted by the shift belt unit 2221 after the bundle is aligned by cooperative operation of the front-end aligning plate 2203 and the rear-end aligning plate 2204. In FIG. 20, a corner shifting roller 2601 is a corner shifting unit that shifts only a corner of an uppermost sheet of a sheet bundle having exposed sheet surfaces on the stacking tray 2202. The corner shifting roller 2601 is rotated while being engaged with the corner of the uppermost sheet of the bundle of sheets P in which the front and side ends in the conveying direction are obliquely shifted to shift only the corner of the uppermost sheet and to largely separate the corner from the corners of the other sheets. In this state, a liquid glue is injected from a glue injecting portion 2301 to the corners of the sheets except for the uppermost sheet, so that the glue does not adhere to the surface of the uppermost sheet.

Figure 21:
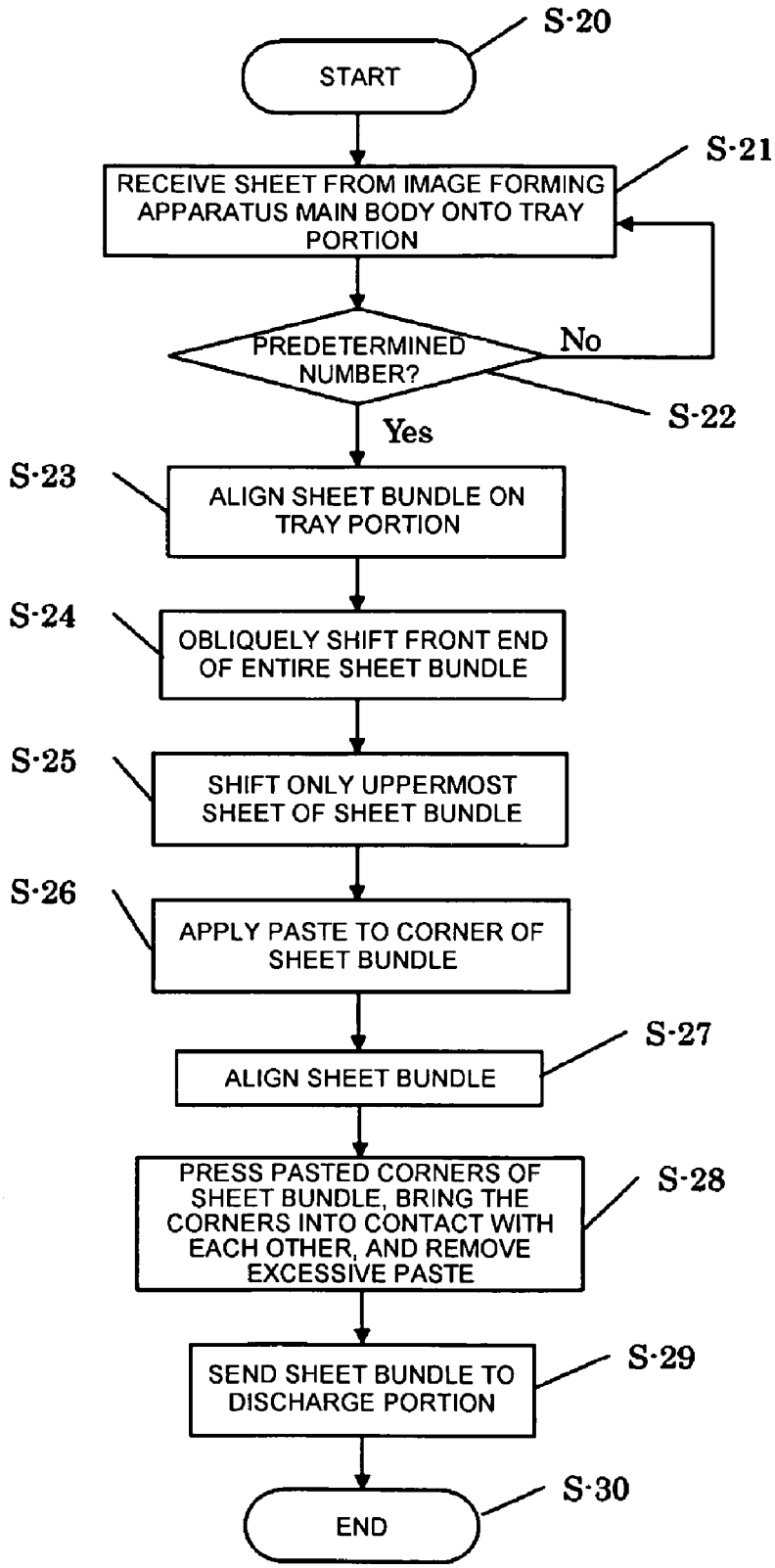
FIG. 21 is a flowchart illustrating an order of pasting operations which glue a predetermined number of sheets in the simplified bookbinding device according to the fifth embodiment.

FIG. 21 is a diagram illustrating a pasting step in the simplified bookbinding device according to the fifth embodiment by a flowchart. In FIG. 21, the pasting step is started in step S-20. Step S-21 is the step of receiving the sheets P sent by a pair of handover rollers 1241 in a recording portion 1200 of an image forming apparatus main body 1000 onto the stacking tray 2202. In step S-22, under the cooperative control of an image forming apparatus main control portion 1100 and a simplified bookbinding device control portion 2100, the number of sheets P stacked on the stacking tray 2202 is detected, and the simplified bookbinding device control portion 2100 determines whether the number of sheets P reaches a predetermined number. When the simplified bookbinding device control portion 2100 determines in step S-22 that the number of sheets P does not reach the predetermined number, the simplified bookbinding device control portion 2100 returns to step S-21 to repeat the step until the number of sheets P reaches the predetermined number. When the simplified bookbinding device control portion 2100 determines that the number of sheets P reaches the predetermined number, the simplified bookbinding device control portion 2100 goes to step S-23. Although not shown, when the predetermined number is 1, or when an operator selects a setting such that pasting is not performed, the simplified bookbinding device control portion 2100 is controlled not to perform the pasting step.

In step S-23, the simplified bookbinding device control portion 2100 controls an operation in that the rear-end aligning plate 2204 abuts against the rear end and the side end of the bundle of sheets P in the conveying direction such that the front end and the side end of the bundle of sheets P in the conveying direction on the stacking tray 2202 are aligned to the front-end aligning plate 2203.

In step S-24, the shift belt unit 2221 is obliquely engaged with the front end side of the bundle of sheets P in the conveying direction on the stacking tray 2202 from above. The simplified bookbinding device control portion 2100 controls the operation of the shift belt unit 2221 such that the bundle of sheets P is entirely obliquely shifted by several millimeters by rotation in a direction opposing the conveying direction.

In step S-25, the corner shifting roller 2601 is engaged with the corner of the uppermost sheet of the bundle of sheets P obliquely shifted by several millimeters in step S-24. The simplified bookbinding device control portion 2100 controls an operation in that rotation is performed such that only the corner of the uppermost sheet moves by several centimeters in the direction in which the corner is separated from the corners of the other sheets.

In step S-26, a glue is injected from the glue injecting portion 2301 to predetermined positions of the sheets except for the uppermost sheet only the corner of which is separated from the corners of the other sheets largely shifted in step S-25 while a liquid glue is appropriately supplied from the glue supply portion 2302 to the glue injecting portion 2301. At this time, a supply timing and a supply amount of the glue of the glue supply portion 2302, a position of the glue injecting portion 2301, an injection timing, an injection amount, and the like are controlled by the simplified bookbinding device control portion 2100 such that an appropriate amount of glue injected from the glue injecting portion 2301 adheres to the position.

In step S-27, the front end and the side end of the bundle of sheets P (except for the uppermost sheet) on which a glue adheres to the predetermined position in step S-26 are moved to be aligned to the front-end aligning plate 2203 such that the rear-end aligning plate 2204 presses the rear end and the side end of the bundle of sheets P in the conveying direction. At the same time, the shift roller 2211 is rotated in such a direction that the bundle of sheets P is conveyed toward the front-end aligning plate 2203. At this time, the shift belt unit 2221 is retreated from the bundle of sheets P. These operations are controlled by the simplified bookbinding device control portion 2100.

In step S-28, the part glued in step S-26 in the bundle of sheets P aligned in step S-27 is pressed by the glued-part pressing member 2311. In this manner, the sheets are brought into press contact with each other to increase adhesive force, and the simplified bookbinding device control portion 2100 controls the operation of the glued-part pressing member 2311 to remove an excessive glue.

In step S-29, the bundle of sheets P the glued portions of which are brought into press contact with each other in step S-28 and from which the excessive glue is removed is discharged onto a discharge tray 2401. The front-end aligning plate 2203 is opened such that the rear-end aligning plate 2204 presses the rear end and the side end of the bundle of sheets P in the conveying direction, and the shift roller 2211 and the shift belt unit 2221 are engaged with the bundle of sheets P and rotated in such a direction that the bundle of sheets P is conveyed. In this manner, the simplified bookbinding device control portion 2100 controls the respective components. With this process, the glued bundle of sheets P is moved from the stacking tray 2202 and discharged onto the discharge tray 2401. In step S-30, the step of pasting a predetermined number of sheets is ended. When the sheet bundle is continuously glued, the simplified bookbinding device control portion 2100 returns to step S-20 to cause the simplified bookbinding device control portion 2100 to repeat the control of one series of steps.

In the simplified bookbinding device 2000 combined with the image forming apparatus main body 1000, a predetermined number of sheets output from the image forming apparatus are stacked to obtain a bundle, and only the corner of the uppermost sheet is largely shifted from the corners of the other sheets to glue the corners of the bundle sheets. In this manner, the sheet bundle is stapled while preventing the glue from adhering to the upper surface of the uppermost sheet, so that a product like a simple book, which can be handled as a booklet independently of other sheet bundles, can be formed. Furthermore, in comparison with the fourth embodiment, since only the corner of the uppermost sheet is moved, the glued uppermost sheet can be easily aligned.

Sixth Embodiment

A sixth embodiment of the present invention will be described below in detail with reference to the accompanying drawings. Parts common to those in the fourth embodiment will be appropriately omitted.

Figure 22:
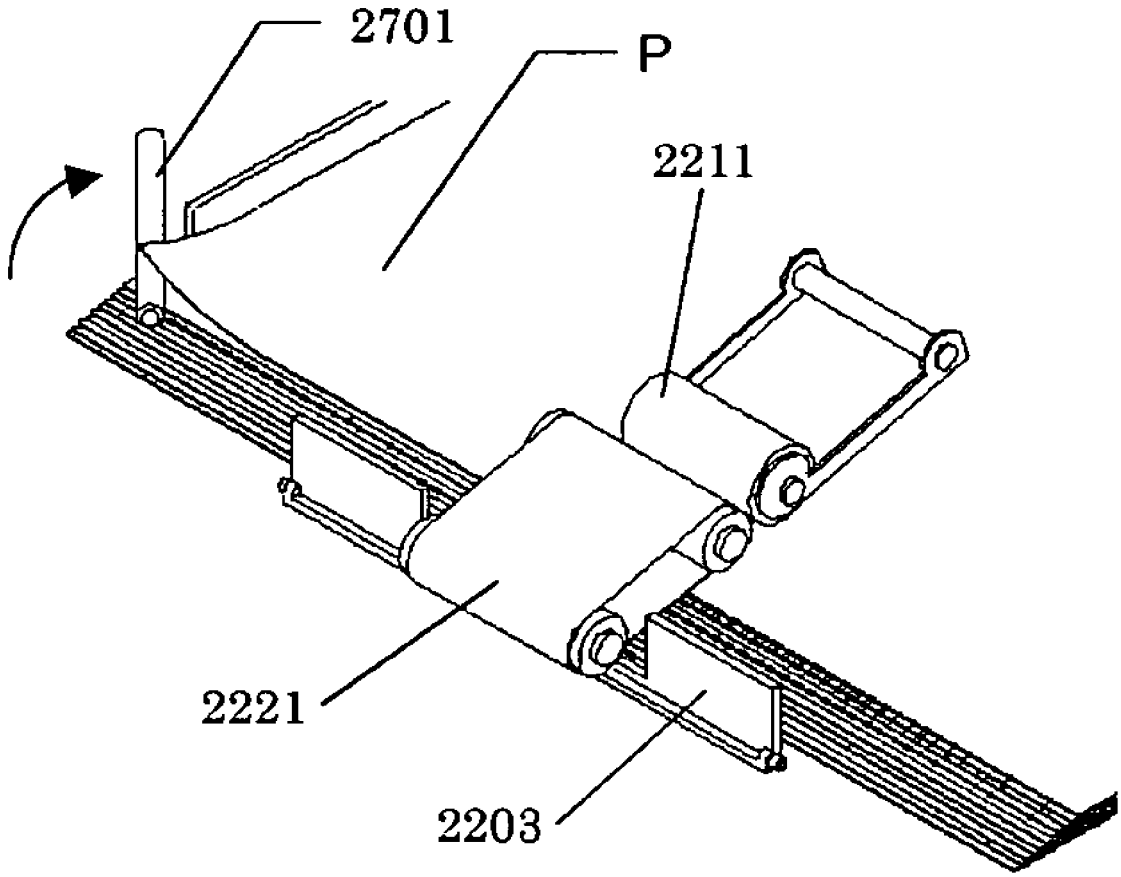
FIG. 22 is a perspective view for explaining a flipping operation for a corner of a sheet in a bookbinding device according to a sixth embodiment.

FIG. 22 is a perspective view illustrating a state immediately before corners of the sheets P stacked on a stacking tray 2202 are glued in a simplified bookbinding device according to the sixth embodiment. As shown in FIG. 22, a front-end side of a bundle of sheets P on the stacking tray 2202 is obliquely shifted by the shift belt unit 2221 after the bundle is aligned by cooperative operation of the front-end aligning plate 2203 and the rear-end aligning plate 2204. In FIG. 22, a corner flipping member 2701 is a separation unit that separates only the corner of the uppermost sheet of the sheet bundle of which the sheet surfaces are exposed on the stacking tray 2202 from the other sheets. The corner flipping member 2701 is inserted between the corner of the uppermost sheet of the bundle of sheets P in the conveying-direction front and side ends of which are obliquely shifted and the corner of the sheet immediately under the uppermost sheet to flip only the corner of the uppermost sheet to separate the uppermost sheet from the other sheets. In this state, a liquid glue is injected from the glue injecting portion 2301 to the corner of the bundle of the other sheets to prevent the glue from adhering to the surface of the uppermost sheet.

Figure 23:
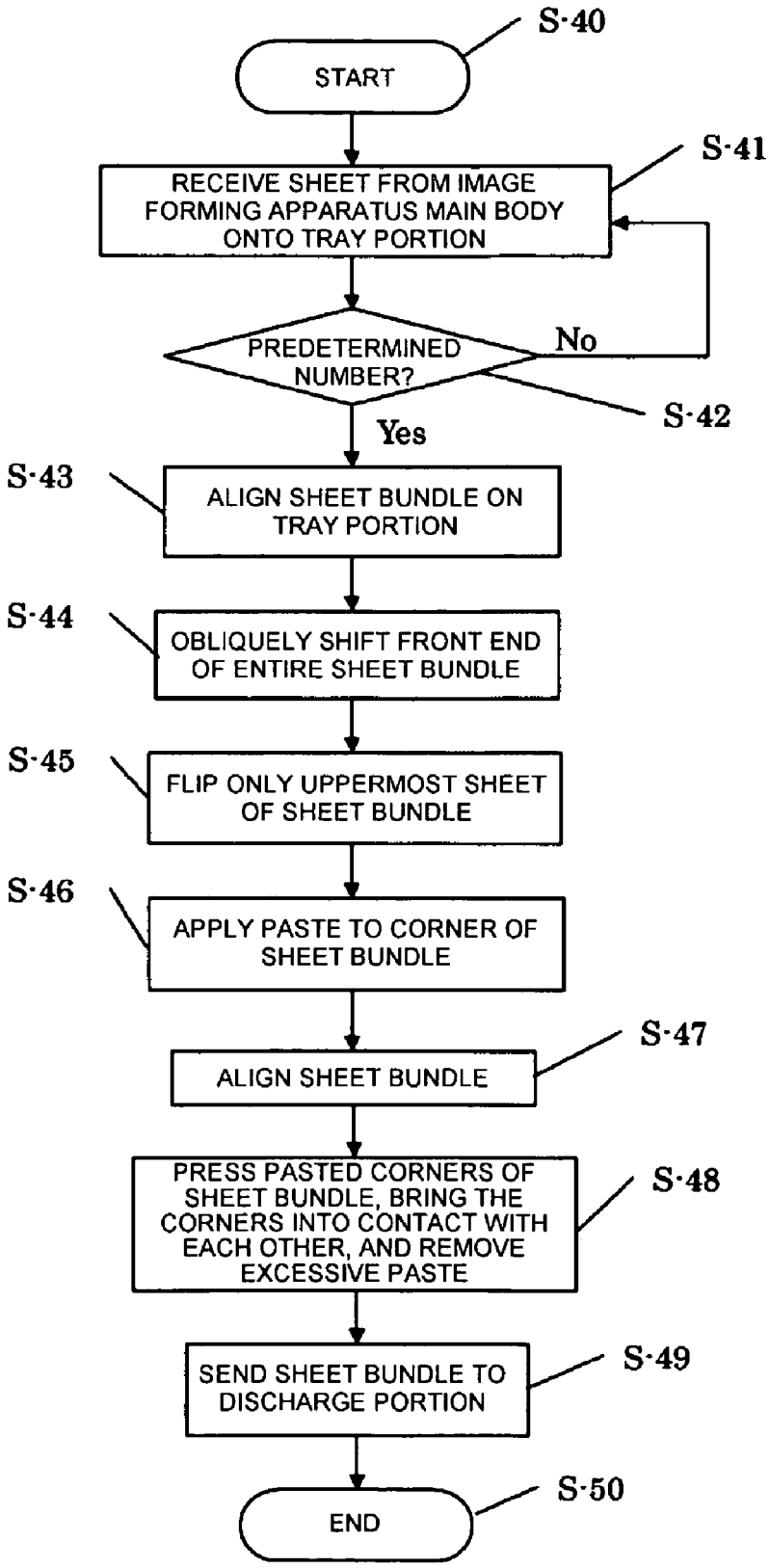
FIG. 23 is a flowchart illustrating an order of pasting operations which glue a predetermined number of sheets in the simplified bookbinding device according to the sixth embodiment.

FIG. 23 is a diagram illustrating a pasting step in the simplified bookbinding device according to the sixth embodiment by a flowchart. In FIG. 23, the pasting step is started in step S-40. Step S-41 is the step of receiving the sheets P sent by a pair of handover rollers 1241 in a recording portion 1200 of an image forming apparatus main body 1000 onto the stacking tray 2202. In step S-42, under the cooperative control of an image forming apparatus main control portion 1100 and a simplified bookbinding device control portion 2100, the number of sheets P stacked on the stacking tray 2202 is detected, and the simplified bookbinding device control portion 2100 determines whether the number of sheets P reaches a predetermined number. When the simplified bookbinding device control portion 2100 determines in step S-42 that the number of sheets P does not reach the predetermined number, the simplified bookbinding device control portion 2100 returns to step S-41 to repeat the step until the number of sheets P reaches the predetermined number. When the simplified bookbinding device control portion 2100 determines that the number of sheets P reaches the predetermined number, the simplified bookbinding device control portion 2100 shifts to step S-43. Although not shown, when the predetermined number is 1, or when an operator selects a setting such that pasting is not performed, the simplified bookbinding device control portion 2100 is controlled not to perform the pasting step.

In step S-43, the simplified bookbinding device control portion 2100 controls an operation in that the rear-end aligning plate 2204 abuts against the rear end and the side end of the bundle of sheets P in the conveying direction such that the front end and the side end of the bundle of sheets P in the conveying direction on the stacking tray 2202 are aligned to the front-end aligning plate 2203.

In step S-44, the shift belt unit 2221 is obliquely engaged with the front end side of the bundle of sheets P in the conveying direction on the stacking tray 2202 from above. The simplified bookbinding device control portion 2100 controls the operation of the shift belt unit 2221 such that the bundle of sheets P is entirely obliquely shifted by several millimeters by rotation in a direction opposing the conveying direction.

In step S-45, the corner flipping member 2701 is engaged with the corner of the uppermost sheet of the bundle of sheets P obliquely shifted by several millimeters in step S-44. The simplified bookbinding device control portion 2100 controls an operation in that rotation is performed such that only the corner of the uppermost sheet moves by several centimeters in the direction in which the corner is separated from the corners of the other sheets.

In step S-46, a glue is injected from the glue injecting portion 2301 to predetermined positions of the sheets except for the uppermost sheet only the corner of which is separated from the corners of the other sheets in step S-45 while a liquid glue is appropriately supplied from the glue supply portion 2302 to the glue injecting portion 2301. At this time, a supply timing and a supply amount of the glue of the glue supply portion 2302, a position of the glue injecting portion 2301, an injection timing, an injection amount, and the like are controlled by the simplified bookbinding device control portion 2100 such that an appropriate amount of glue injected from the glue injecting portion 2301 adheres to the position.

In step S-47, the front end and the side end of the bundle of sheets P (except for the uppermost sheet) on which a glue adheres to the predetermined position in step S-46 are moved to be aligned to the front-end aligning plate 2203 such that the rear-end aligning plate 2204 presses the rear end and the side end of the bundle of sheets P in the conveying direction. At the same time, the shift roller 2211 is rotated in such a direction that the bundle of sheets P is conveyed toward the front-end aligning plate 2203. At this time, the shift belt unit 2221 is retreated from the bundle of sheets P. These operations are controlled by the simplified bookbinding device control portion 2100.

In step S-48, the part glued in step S-46 in the bundle of sheets P aligned in step S-47 is pressed by the glued-part pressing member 2311. In this manner, the sheets are brought into press contact with each other to increase adhesive force, and the simplified bookbinding device control portion 2100 controls the operation of the glued-part pressing member 2311 to remove an excessive glue.

In step S-49, the bundle of sheets P the glued portions of which are brought into press contact with each other in step S-48 and from which the excessive glue is removed is discharged onto a discharge tray 2401. The front-end aligning plate 2203 is opened such that the rear-end aligning plate 2204 presses the rear end and the side end of the bundle of sheets P in the conveying direction, the shift roller 2211 and the shift belt unit 2221 are also engaged with the bundle of sheets P and rotated in such a direction that the bundle of sheets P is conveyed. In this manner, the simplified bookbinding device control portion 2100 controls the respective components. With this process, the glued bundle of sheets P is moved from the stacking tray 2202 and discharged onto the discharge tray 2401. In step S-50, the step of pasting a predetermined number of sheets is ended. When the sheet bundle is continuously glued, the simplified bookbinding device controlling portion 2100 returns to step S-40 to cause the simplified bookbinding device control portion 2100 to repeat the control of one series of steps.

In the simplified bookbinding device 2000 constructed in combination with the image forming apparatus main body 1000, a predetermined number of sheets output from the image forming apparatus are stacked to obtain a bundle, and only the corner of the uppermost sheet is flipped from the corners of the other sheets to glue the corners of the bundle sheets. In this manner, the sheet bundle is stapled while preventing the glue from adhering to the upper surface of the corner of the uppermost sheet, so that a product like a simple book, which can be handled as a booklet independently of other sheet bundles, can be formed. Furthermore, in comparison with the fourth embodiment, as in the fifth embodiment, after the pasting, the glued uppermost sheet can be easily aligned. In comparison with the fifth embodiment, when the corners of the sheets except for the uppermost sheet are glued, the uppermost sheet is largely separated. With this process, the glue does not easily adhere to the surface of the uppermost sheet which is not required to be glued.

Seventh Embodiment

A seventh embodiment of the present invention will be described below in detail with reference to the accompanying drawings. Parts common to those in the fourth embodiment will be appropriately omitted.

FIGS. 24A to 24H are process explanatory views for explaining pasting steps for a sheet bundle in a simplified bookbinding device according to the seventh embodiment.

Figure 24A:
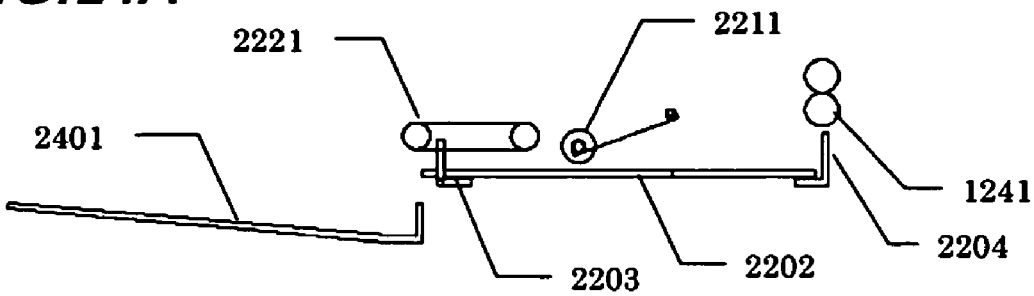
FIG. 24A is an explanatory diagram of a sheet pasting step in a simplified bookbinding device according to a seventh embodiment.

FIG. 24A illustrates a standby state before a sheet is sent from a recording portion 1200 of an image forming apparatus main body 1000 to a simplified bookbinding device 2000.

Figure 24B:
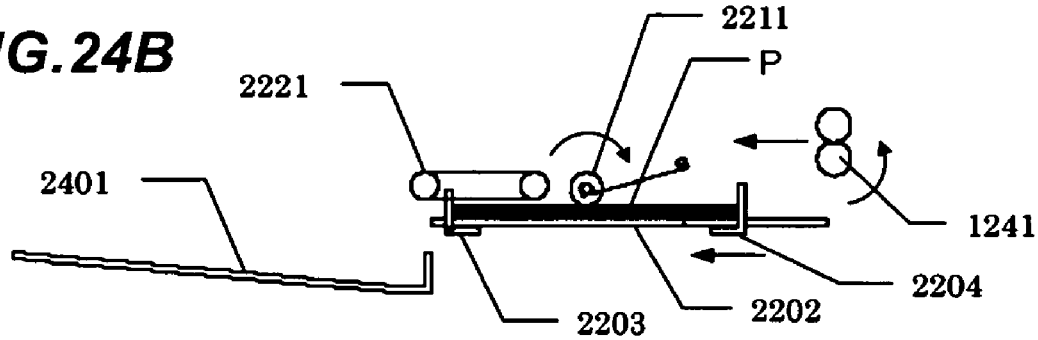
FIG. 24B is an explanatory diagram of a sheet pasting step in the simplified bookbinding device according to the seventh embodiment.

FIG. 24B illustrates a state in that a sheet P is sent from the recording portion 1200 of the image forming apparatus main body 1000 to the simplified bookbinding device 2000. At this time, a pair of handover rollers 1241 and a shift roller 2211 are rotated in a direction of arrow C which is a conveying direction of the sheets P, and the sheets P are sequentially stacked on the stacking tray 2202. When the number of sheets P stacked on the stacking tray 2202 reaches the number of sheets which is smaller than a predetermined number by one, a front-end aligning plate 2203, a rear-end aligning plate 2204, and width aligning plates 2205 and 2206 (see FIG. 14) are cooperated to align the sides of the quadrangular sheets P. In this case, the predetermined number is the number of sheets of one bundle to be glued.

Figure 24C:
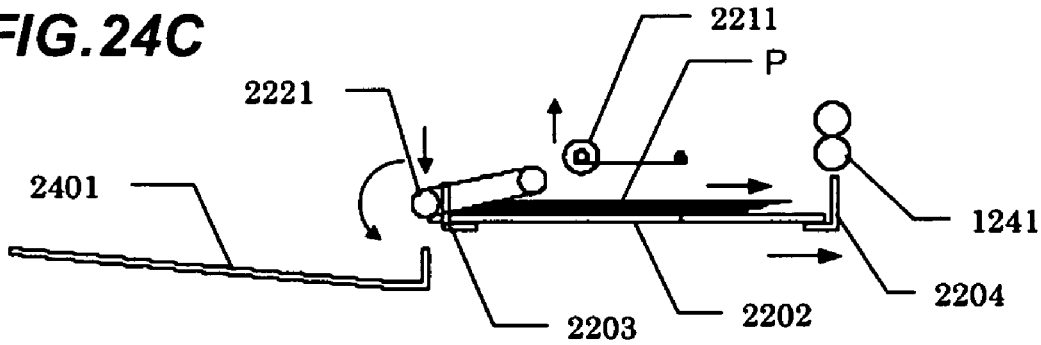
FIG. 24C is an explanatory diagram of a sheet pasting step in the simplified bookbinding device according to the seventh embodiment.

In FIG. 24C, the shift roller 2211 and the rear-end aligning plate 2204 are retreated to a position where the shift roller 2211 and the rear-end aligning plate 2204 are not engaged with the sheet P. Thereafter, the shift belt unit 2221 is engaged with the bundle of sheets P the four sides of which are aligned such that front-end sides in the conveying direction is obliquely pressed from above. Herewith, the shift belt unit 2221 is rotated such that the sheets are pressed backward in a direction of arrow D which opposes the direction in which the sheets are conveyed. In this manner, the bundle of sheets P is set in a state in that the stacked sheets are sequentially shifted from the uppermost sheet by a predetermined amount (several millimeters).

Figure 24D:
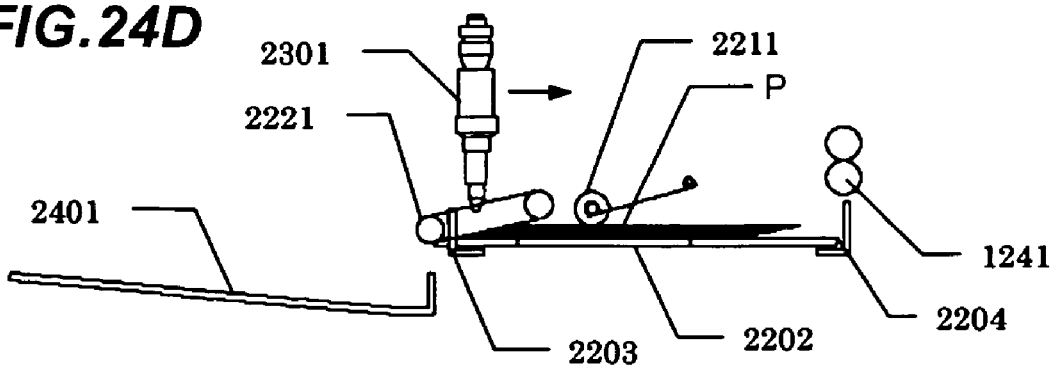
FIG. 24D is an explanatory diagram of a sheet pasting step in the simplified bookbinding device according to the seventh embodiment.

In FIG. 24D, the glue injecting portion 2301 is moved from a standby position to a position where a glue is injected to glue the corners of the sheets P. Furthermore, the glue injecting portion 2301 injects a proper amount of glue to predetermined corners of the sheets P while supplying a liquid glue from the glue supply portion 2302 and being moved.

Figure 24E:
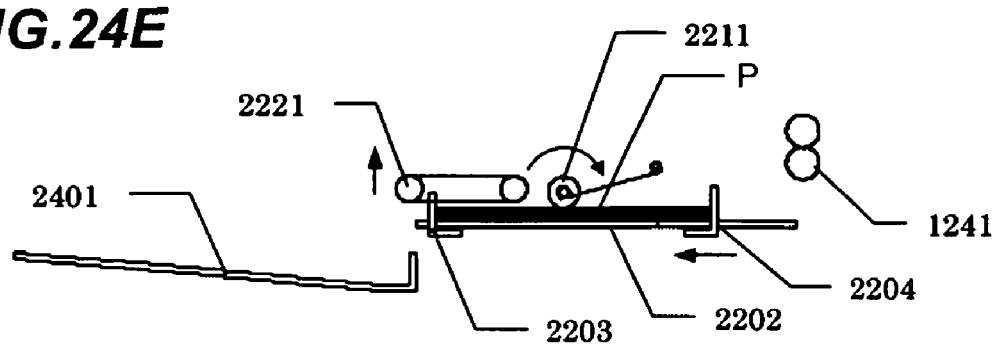
FIG. 24E is an explanatory diagram of a sheet pasting step in the simplified bookbinding device according to the seventh embodiment.

In FIG. 24E, the shift belt unit 2221 is moved to a standby position where the shift belt unit 2221 is not engaged with the sheet P. Thereafter, the shift roller 2211 is rotated in the same direction in which the sheets are sent from the pair of handover rollers 1241 while being engaged with the uppermost sheet P of the sheet bundle. At the same time, the rear-end aligning plate 2204 is moved to press the rear-ends of the bundle of sheets P in the conveying direction. In this manner, the conveying-direction front-end side of the bundle of sheets P having corners to which the glue adheres is aligned to the front-end aligning plate 2203 again. More specifically, the shift roller 2211, the rear-end aligning plate 2204, and the front-end aligning plate 2203 function as a sheet bundle aligning portion that sets the bundle of glued sheets P on the stacking tray 2202 in a state in which two orthogonal sides of each sheet are aligned. The bundle of sheets P is aligned to cause the sheets P to adhere to each other. At this time, the glue adheres to the upper surface side of the uppermost sheet.

Figure 24F:
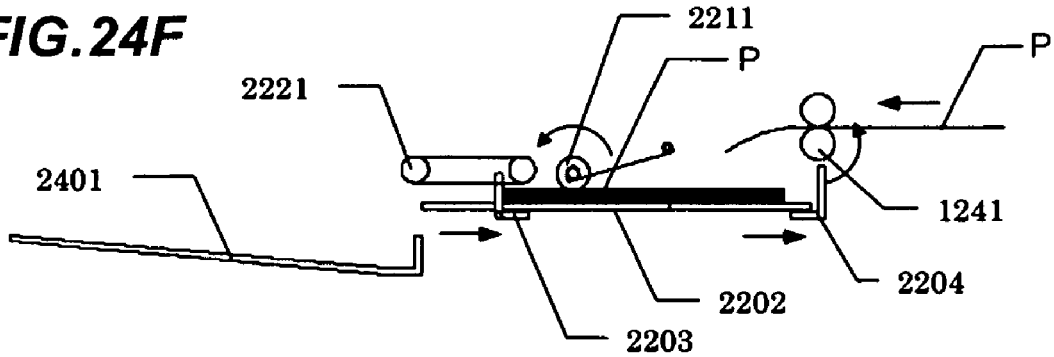
FIG. 24F is an explanatory diagram of a sheet pasting step in the simplified bookbinding device according to the seventh embodiment.

In FIG. 24F, the glued and aligned bundle of sheets P is moved on the stacking tray 2202 in a direction opposing the conveying direction (bundle discharge direction) together with the front-end aligning plate 2203 and the rear-end aligning plate 2204. Together with this movement, the shift roller 2211 is rotated in a direction opposing the conveying direction of the bundle of sheets P. In this manner, the bundle of sheets P is moved to a position where a last sheet can be received from the pair of handover rollers 1241. Thereafter, the last sheet of the sheet bundle to be glued is sent onto the sheets P the corners of which are glued and which are aligned.

Figure 24G:
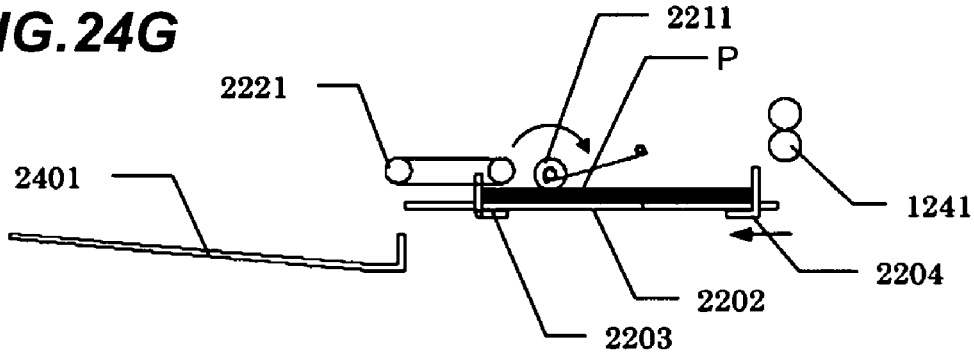
FIG. 24G is an explanatory diagram of a sheet pasting step in the simplified bookbinding device according to the seventh embodiment.

In FIG. 24G, the shift roller 2211 is rotated on the bundle of sheets P the corners of which are glued, so that the last sheet is conveyed until a front end of the sent last sheet abuts against the front-end aligning plate 2203. Furthermore, the rear-end aligning plate 2204 aligns a bundle of sheets P aligned in advance to the last sheet. At this time, a glue is not applied to the last sheet. In the bundle of sheets P aligned in advance, since a glue adheres to the upper surface of a predetermined corner of the uppermost sheet, the last sheet superposed on the corner, and the lower surface of the corner is adhered to the sheet immediately thereunder. In this state, as in FIG. 17 in the fourth embodiment, a corner of the glued sheet P is nipped and pressed by the glued-part pressing member 2311. In this manner, the sheets of the bundle of sheets P are brought into press contact with each other to increase adhesive force, and excessive glue is removed. In this case, when the glue is not easily dried, a glue-drying unit that sends air or applies heat may be additionally provided.

Figure 24H:
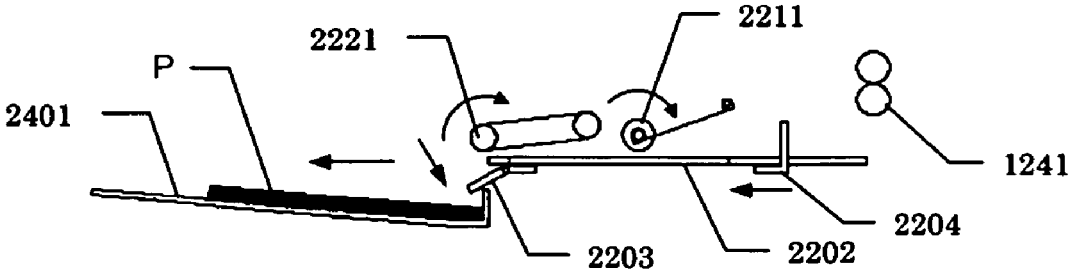
FIG. 24H is an explanatory diagram of a sheet pasting step in the simplified bookbinding device according to the seventh embodiment.

In FIG. 24H, the front-end aligning plate 2203 is opened, the glued and aligned bundle of sheets P is pressed by the rear-end aligning plate 2204. At the same time, the shift roller 2211 and the shift belt unit 2221 are brought into contact with the bundle of sheets P to be rotated in a direction in which the bundle is sent toward the discharge tray 2401. In this manner, the bundle of sheets P is discharged from the upper side of the stacking tray 2202 to the upper side of the discharge tray 2401.

Figure 25:
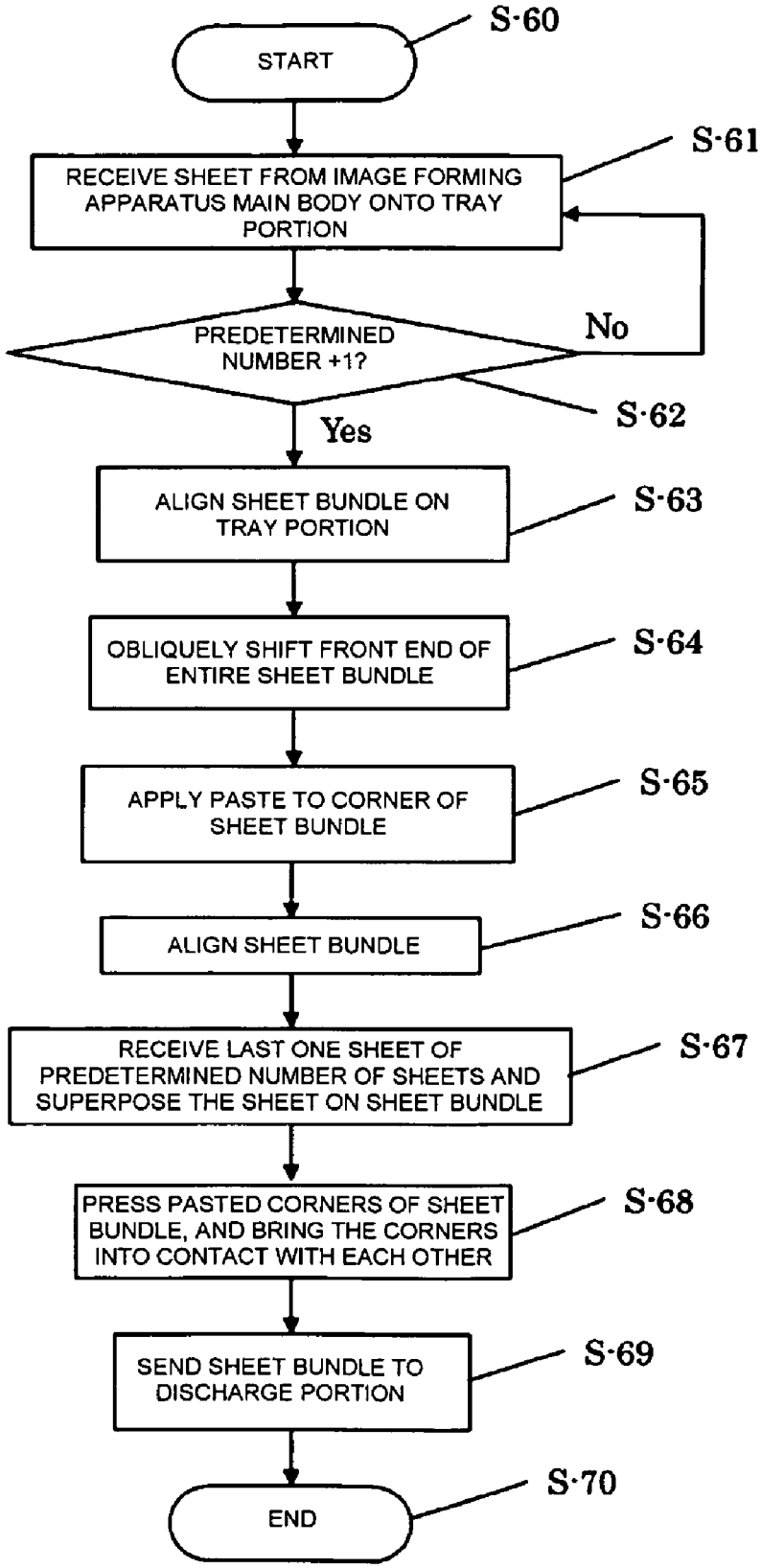
FIG. 25 is a flowchart illustrating an order of pasting operations which glue a predetermined number of sheets in the simplified bookbinding device according to the sixth embodiment.

FIG. 25 is a diagram illustrating a pasting step in the simplified bookbinding device according to the seventh embodiment by a flowchart. In FIG. 25, the pasting step is started in step S-60. Step S-61 is the step of receiving the sheets P sent by the pair of handover rollers 1241 in the recording portion 1200 of the image forming apparatus main body 1000 onto the stacking tray 2202. In step S-62, the number of sheets P stacked on the stacking tray 2202 is detected. In cooperation with the image forming apparatus main control portion 1100, the simplified bookbinding device control portion 2100 determines whether the number of sheets P reaches a number which is smaller than a predetermined number of sheets by one. In this case, the predetermined number of sheets is the number of sheets of one bundle to be glued. When the simplified bookbinding device control portion 2100 determines in step S-62 that the number of sheets P does not reach the number which is smaller than the predetermined number by one, the simplified bookbinding device control portion 2100 returns to step S-61 to repeat the step until the number of sheets P reaches the number which is smaller than the predetermined number by one. When the simplified bookbinding device control portion 2100 determines that the number of sheets P reaches the number which is smaller than the predetermined number by one, the simplified bookbinding device control portion 2100 shifts to step S-63. Although not shown, when the predetermined number is 1, or when an operator selects a setting such that pasting is not performed, the simplified bookbinding device control portion 2100 is controlled not to perform the pasting step.

In step S-63, the simplified bookbinding device control portion 2100 controls an operation in that the rear-end aligning plate 2204 abuts against the rear end and the side end of the bundle of sheets P in the conveying direction such that the front end and the side end of the bundle of sheets P in the conveying direction on the stacking tray 2202 are aligned to the front-end aligning plate 2203.

In step S-64, the shift belt unit 2221 is obliquely engaged with the front end side of the bundle of sheets P in the conveying direction on the stacking tray 2202 from above. The simplified bookbinding device control portion 2100 controls the operation of the shift belt unit 2221 such that the bundle of sheets P is entirely obliquely shifted by several millimeters by rotation in a direction opposing the conveying direction.

In step S-65, a glue is injected from the glue injecting portion 2301 to predetermined positions of the sheets entirely shifted in step S-64 while a liquid glue is appropriately supplied from the glue supply portion 2302 to the glue injecting portion 2301. At this time, a supply timing and a supply amount of the glue of the glue supply portion 2302, a position of the glue injecting portion 2301, an injection timing, an injection amount, and the like are controlled by the simplified bookbinding device control portion 2100 such that an appropriate amount of glue injected from the glue injecting portion 2301 adheres to the position.

In step S-66, the front end and the side end of the bundle of sheets P on which a glue adheres to the predetermined position in step S-65 are moved to be aligned to the front-end aligning plate 2203 such that the rear-end aligning plate 2204 presses the rear end and the side end of the bundle of sheets P in the conveying direction. At the same time, the shift roller 2211 is rotated in such a direction that the bundle of sheets P is conveyed toward the front-end aligning plate 2203. At this time, the shift belt unit 2221 is retreated from the bundle of sheets P. These operations are controlled by the simplified bookbinding device control portion 2100.

In step S-67, a last sheet of a predetermined number of sheets to be glued is sent. The shift roller 2211 is rotated above the bundle of sheets P the corners of which are glued, so that the sent last sheet is conveyed until the sheet abuts against the front-end aligning plate 2203. The rear-end aligning plate 2204 aligns the bundle of sheets P aligned in advance to the last sheet. In this manner, the simplified bookbinding device control portion 2100 controls operations of the shift roller 2211, the front-end aligning plate 2203, the rear-end aligning plate 2204, and the like.

In step S-68, the part glued in step S-65 in the bundle of sheets P aligned in step S-67 is pressed by the glued-part pressing member 2311. In this manner, the sheets are brought into press contact with each other to increase adhesive force, and an excessive glue is removed. As described above, the simplified bookbinding device control portion 2100 controls the operation of the glued-part pressing member 2311.

In step S-69, the bundle of sheets P the glued portions of which are brought into press contact with each other in step S-68 and from which the excessive glue is removed is discharged onto a discharge tray 2401. The front-end aligning plate 2203 is opened such that the rear-end aligning plate 2204 presses the rear end and the side end of the bundle of sheets P in the conveying direction, and the shift roller 2211 and the shift belt unit 2221 are engaged with the bundle of sheets P and rotated in such a direction that the bundle of sheets P is conveyed. In this manner, the simplified bookbinding device control portion 2100 controls the respective components. With this process, the glued bundle of sheets P is moved from the stacking tray 2202 and discharged onto the discharge tray 2401. In step S-70, the step of pasting a predetermined number of sheets is ended. When the sheet bundle is continuously glued, the simplified bookbinding device control portion 2100 returns to step S-60 to cause the simplified bookbinding device control portion 2100 to repeat the control of one series of steps.

In the simplified bookbinding device 2000 constructed in combination with the image forming apparatus main body 1000, sheets the number of which is smaller than the predetermined number by one and which are output from the image forming apparatus are stacked to obtain a bundle, and corners of the bundle sheet shape are glued. Thereafter, the last sheet is superposed on the bundle, and the resultant bundle is stapled while preventing a glue from adhering to the upper surface of the uppermost sheet, a product like a simple book which can be handled as a booklet independently of other sheet bundles can be formed.

Another Embodiment

The fourth to seventh embodiments illustrate a configuration in that an attitude of a sheet bundle stacked and aligned on the stacking tray 2202 is changed, and an adhesive agent is applied to the sheet surfaces exposed by the change in attitude collectively. However, the present invention is not limited to the configuration. For example, as described in the second embodiment, sheets discharged on the stacking tray may be stacks such that parts of the sheet surfaces of the sheet bundle are exposed, and an adhesive agent may be applied to the exposed parts of the sheet surfaces of the sheet bundle stacked in this manner collectively. According to this configuration, not only the same effects as those in the fourth to seventh embodiments but also further improvement of the productivity of glued sheet bundles can be obtained.

In the fourth to seventh embodiments, in a stacking state of a sheet bundle in a pasting state, one of two orthogonal sides of each sheet is aligned to the same plane, and the other sides are stacked to be shifted by a predetermined amount, so that a pasting region is assured. However, the present invention is not limited to this configuration. For example, sheets are rotationally displaced about one corner of an aligned sheet bundle by a sheet bundle displacing unit to shift the sheets by a predetermined amount in a rotational direction, so that an application region for an adhesive agent can also be assured.

In the above embodiments, a printer is illustrated as an image forming apparatus. However, the present invention is not limited to the printer. For example, another image forming apparatus such as a copying machine or a fax machine or another image forming apparatus such as a complex machine obtained by combining these functions may be used. The present invention is applied to the sheet processing apparatus used in the image forming apparatus, the same effect as described above can be obtained.

In the embodiments, a sheet processing apparatus connected to an image forming apparatus is illustrated. However, the present invention is not limited to the sheet processing apparatus. For example, a sheet processing apparatus integrally included in an image processing apparatus may be used. When the present invention is applied to the sheet processing apparatus, the same effect as described above can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The application claims the benefit of Japanese Patent Application No. 2007-142899, filed May 30, 2007, and No. 2008-131800, filed May 20, 2008, which are hereby incorporated by reference herein in their entirety.

What is claimed is:

1. A sheet processing apparatus comprising:

a sheet stacking portion that stacks a sheet discharged from a sheet discharge portion;

a sheet bundle displacing unit that displaces a sheet bundle stacked on the sheet stacking portion to partially expose sheet surfaces; and a glue applying unit that applies the glue to the exposed parts of the sheet surfaces of the displaced sheet bundle on the sheet stacking portion, wherein the sheet bundle displacing unit rotationally displaces the sheets about one corner of the sheet bundle to shift the sheets in a rotational direction by a predetermined amount in each of sheets.

2. The sheet processing apparatus according to claim 1, further comprising a sheet bundle aligning portion that aligns an end surface of the glued sheet bundle on the sheet stacking portion.

3. The sheet processing apparatus according to claim 1, wherein the glue applying unit applies a glue on the exposed sheet surfaces while moving along the exposed sheet surfaces of the sheet bundle.

4. An image forming apparatus comprising:

an image forming portion that forms an image on a sheet; and a sheet processing apparatus that performs processing to the sheet on which the image is formed, wherein the sheet processing apparatus includes:

a sheet stacking portion that stacks a sheet discharged from a sheet discharge portion;

a sheet bundle displacing unit that displaces a sheet bundle stacked on the sheet stacking portion to partially expose sheet surfaces; and a glue applying unit that applies the glue to the exposed parts of the sheet surfaces of the displaced sheet bundle on the sheet stacking portion.

5. The image forming apparatus according to claim 4, further comprising a sheet bundle aligning portion that aligns an end surface of the glued sheet bundle on the sheet stacking portion.

6. The image forming apparatus according to claim 4, wherein the sheet bundle displacing unit shifts one side of the sheets by a predetermined amount in each of sheets.

7. The image forming apparatus according to claim 4, wherein the sheet bundle displacing unit rotationally displaces the sheets about one corner of the sheet bundle to shift the sheets in a rotational direction by a predetermined amount in each of sheets.

8. The image forming apparatus according to claim 4, wherein the glue applying unit applies a glue on the exposed sheet surfaces while moving along the exposed sheet surfaces of the sheet bundle.

9. The image forming apparatus according to claim 8, wherein the glue applying unit completes a glue applying process without applying a glue to the uppermost sheet.

10. The image forming apparatus according to claim 9, wherein a controller that performs control such that the uppermost sheet of one sheet bundle is stacked after the glue is applied to the other sheets on the sheet stacking portion is provided.

11. The image forming apparatus according to claim 4, wherein a separation unit that separates the uppermost sheet from the other sheets of the sheet bundle of which the sheet surfaces are exposed on the sheet stacking portion.

12. A sheet processing apparatus comprising:

a sheet stacking portion that stacks a sheet discharged from a sheet discharge portion;

a sheet bundle displacing unit that displaces a sheet bundle stacked on the sheet stacking portion to partially expose sheet surfaces; and a glue applying unit that applies the glue to the exposed parts of the sheet surfaces of the displaced sheet bundle on the sheet stacking portion, wherein the glue applying unit applies a glue on the exposed sheet surfaces while moving along the exposed sheet surfaces of the sheet bundle, the glue applying unit applies a glue on the exposed sheet surfaces while moving along the exposed sheet surfaces of the sheet bundle, and the glue applying unit completes a glue applying process without applying a glue to the uppermost sheet.

13. The sheet processing apparatus according to claim 12, wherein the sheet bundle displacing unit shifts one side of the sheets by a predetermined amount in each of sheets.

14. The sheet processing apparatus according to claim 12, wherein a controller that performs control such that the uppermost sheet of one sheet bundle is stacked after the glue is applied to the other sheets on the sheet stacking portion is provided.

15. A sheet processing apparatus comprising:

a sheet stacking portion that stacks a sheet discharged from a sheet discharge portion;

a sheet bundle displacing unit that displaces a sheet bundle stacked on the sheet stacking portion to partially expose sheet surfaces;

a glue applying unit that applies the glue to the exposed parts of the sheet surfaces of the displaced sheet bundle on the sheet stacking portion; and a sheet shifting unit that shifts the uppermost sheet on the sheet stacking portion largely more than the other sheets, wherein the glue applying unit applies a glue on the exposed sheet surfaces while moving along the exposed sheet surfaces of the sheet bundle.

16. The sheet processing apparatus according to claim 15, further comprising a sheet bundle aligning portion that aligns an end surface of the glued sheet bundle on the sheet stacking portion.

17. The sheet processing apparatus according to claim 15, wherein the sheet bundle displacing unit shifts one side of the sheets by a predetermined amount in each of sheets.

18. The sheet processing apparatus according to claim 15, wherein the glue applying unit applies a glue on the exposed sheet surfaces while moving along the exposed sheet surfaces of the sheet bundle.

19. A sheet processing apparatus comprising:

a sheet stacking portion that stacks a sheet discharged from a sheet discharge portion;

a sheet bundle displacing unit that displaces a sheet bundle stacked on the sheet stacking portion to partially expose sheet surfaces; and a glue applying unit that applies the glue to the exposed parts of the sheet surfaces of the displaced sheet bundle on the sheet stacking portion;

wherein the glue applying unit applies a glue on the exposed sheet surfaces while moving along the exposed sheet surfaces of the sheet bundle, and the glue applying unit applies a glue to corners of the exposed sheet surfaces, and a corner shifting unit that shifts a corner of the uppermost sheet of the sheet bundle of which the sheet surfaces are exposed on the sheet stacking portion is provided.

20. The sheet processing apparatus according to claim 19, further comprising a sheet bundle aligning portion that aligns an end surface of the glued sheet bundle on the sheet stacking portion.

21. The sheet processing apparatus according to claim 19, wherein the glue applying unit applies a glue on the exposed sheet surfaces while moving along the exposed sheet surfaces of the sheet bundle.

22. A sheet processing apparatus comprising:

a sheet stacking portion that stacks a sheet discharged from a sheet discharge portion;

a sheet bundle displacing unit that displaces a sheet bundle stacked on the sheet stacking portion to partially expose sheet surfaces; and a glue applying unit that applies the glue to the exposed parts of the sheet surfaces of the displaced sheet bundle on the sheet stacking portion;

wherein the glue applying unit applies a glue on the exposed sheet surfaces while moving along the exposed sheet surfaces of the sheet bundle, and a separation unit that separates the uppermost sheet from the other sheets of the sheet bundle of which the sheet surfaces are exposed on the sheet stacking portion.

23. The sheet processing apparatus according to claim 22, further comprising a sheet bundle aligning portion that aligns an end surface of the glued sheet bundle on the sheet stacking portion.

24. The sheet processing apparatus according to claim 22, wherein the sheet bundle displacing unit shifts one side of the sheets by a predetermined amount in each of sheets.

25. The sheet processing apparatus according to claim 22, wherein the glue applying unit applies a glue on the exposed sheet surfaces while moving along the exposed sheet surfaces of the sheet bundle.

* * * * *